US009567780B2

(12) United States Patent
Behnke et al.

(10) Patent No.: US 9,567,780 B2
(45) Date of Patent: Feb. 14, 2017

(54) PULL HANDLE FOR A VEHICLE DOOR

(71) Applicant: D. La Porte Söhne GmbH, Wuppertal (DE)

(72) Inventors: Peter Behnke, Bochum (DE); Viktor Komkin, Wuppertal (DE)

(73) Assignee: D. La Porte Söhne GmbH, Wuppertal (DE)

( * ) Notice: Subject to any disclaimer, the term of this patent is extended or adjusted under 35 U.S.C. 154(b) by 193 days.

(21) Appl. No.: 14/506,998

(22) Filed: Oct. 6, 2014

(65) Prior Publication Data

US 2015/0096339 A1 Apr. 9, 2015

(30) Foreign Application Priority Data

Oct. 7, 2013 (DE) ..... 10 2013 016 606

(51) Int. Cl.

| | |
|---|---|
| ***E05B 13/00*** | (2006.01) |
| ***E05B 79/06*** | (2014.01) |
| ***E05B 85/16*** | (2014.01) |
| ***E05B 85/06*** | (2014.01) |

(52) U.S. Cl.

CPC ..... *E05B 85/16* (2013.01); *E05B 13/005* (2013.01); *E05B 79/06* (2013.01); *E05B 85/06* (2013.01); *Y10T 70/5889* (2015.04); *Y10T 292/57* (2015.04)

(58) Field of Classification Search

CPC ..... E05B 79/00; E05B 79/02; E05B 79/04; E05B 79/06; E05B 85/06; E05B 85/10; E05B 85/14; E05B 85/16

See application file for complete search history.

(56) References Cited

U.S. PATENT DOCUMENTS

| | | | | |
|---|---|---|---|---|
| 6,415,636 | B1 * | 7/2002 | Fukumoto | B60J 5/0412 292/336.3 |
| 7,146,832 | B2 * | 12/2006 | Mathofer | E05B 79/06 292/336.3 |
| 8,562,039 | B2 * | 10/2013 | Ichikawa | E05B 85/16 292/336.3 |

(Continued)

FOREIGN PATENT DOCUMENTS

| | | |
|---|---|---|
| DE | 103 43 355 A1 | 7/2004 |
| DE | 10 2006 012 956 A1 | 3/2007 |

(Continued)

OTHER PUBLICATIONS

German Examination Report—Jan. 29, 2015.
European Search Report—May 18, 2015.

*Primary Examiner* — Christopher Boswell
(74) *Attorney, Agent, or Firm* — Brinks Gilson & Lione

(57) ABSTRACT

A pull handle (1) to unlock a lock of a vehicle door or lift-gate having a pull handle housing (1*a*) with a bearing part (2) for securing on a vehicle door or lift-gate and a handle part (3) connected to the bearing part (2) rotatable around a rotation axis (170). The handle part (3) is rotatable by pulling from a non-activated to an activated position. An activation mechanism (4) mounted in the pull handle housing (1*a*) unlocks the lock, and can be activated by pulling on the handle part (3) and having a coupling element (56, 146) mounted in the pull handle housing (1*a*) to couple with external elements to unlock the lock. A locking mechanism (5) is located completely in the pull handle housing (1*a*) and the activation mechanism (4) can be disabled so that a pulling on the handle part (3) does not unlock the lock.

43 Claims, 28 Drawing Sheets

(56) References Cited

U.S. PATENT DOCUMENTS

| | | | | |
|---|---|---|---|---|
| 8,746,758 | B2 * | 6/2014 | Savant | E05B 77/06 292/336.3 |
| 8,833,810 | B2 * | 9/2014 | Koizumi | E05B 77/06 292/336.3 |
| 8,959,964 | B2 * | 2/2015 | Hidaka | E05B 79/06 292/336.3 |
| 9,322,200 | B1 * | 4/2016 | Shimizu | E05B 85/16 |
| 2004/0113441 | A1 | 6/2004 | Lane et al. | |
| 2004/0227354 | A1 * | 11/2004 | Pantke | E05B 17/041 292/201 |
| 2008/0178646 | A1 | 7/2008 | Schwickerath | |
| 2009/0031768 | A1 | 2/2009 | Yamaguchi et al. | |
| 2009/0134638 | A1 | 5/2009 | Kutschat | |
| 2013/0233034 | A1 * | 9/2013 | Ono | E05B 79/06 70/101 |
| 2015/0322699 | A1 * | 11/2015 | Ilardo | E05B 77/06 292/336.3 |

FOREIGN PATENT DOCUMENTS

| | | | |
|---|---|---|---|
| DE | 10 2008 007 322 | A1 | 8/2008 |
| EP | 1 079 048 | A1 | 2/2001 |
| EP | 1302613 | A1 | 4/2003 |
| JP | 2008-261129 | | 10/2008 |
| WO | 02/070840 | A2 | 9/2002 |

* cited by examiner

PULL HANDLE FOR A VEHICLE DOOR

CROSS-REFERENCE TO RELATED APPLICATIONS

This application claims priority to German Patent Application No. 10 2013 016 606.3, filed Oct. 7, 2014.

FIELD OF THE INVENTION

This invention relates to a pull handle for releasing the lock of a vehicle door or lift-gate, in particular a door or lift-gate of an agricultural vehicle, e.g. a tractor or a construction machine.

BACKGROUND

A vehicle lock of the above referenced type is known for example from DE 10 2006 012 956 A1. The vehicle lock features as described therein two catches between which a locking bolt can be accommodated. In the locked position of the vehicle lock the catches so enclose the locking bolt that the vehicle door is held in its locked position. The two catches are thereby held in their position holding the locking bolt by two pawls. The pawls lock the catches. This locking can be undone by means of an activating lever. The activating lever engages into the lock box. A rotation of the activation lever causes the pawls to release the catches and these in turn release the locking bolt.

The unlocking of a vehicle lock, namely in the case of DE 10 2006 012 956 A1 the activation of the activating lever, can thereby occur, for example, by means of a pressure knob or a pull handle. The pressure knob or the pull handle then features an activation mechanism to release the lock which in the case of DE 10 2006 012 956 A1 is associated with the activation lever. The activation mechanism can thereby be locked and unlocked, for example, by means of a cylinder lock. If the activating mechanism is blocked, the lock can no longer be unlocked.

A vehicle pull handle is known for example from DE 103 43 355 B4. This pull handle features a bearing housing with a mounting base plate, an activation handle connected to the mounting base plate so as to rotate, as well as an activation mechanism to release the catch lock. The activation handle is mounted on a pin which is also mounted on the mounting base plate. A spring unit presses the activation handle into its non-activated, normal position. The activation mechanism of the pull handle features a connecting element which is permanently connected to the activation handle and thus turns with it during activation. The connecting element thereby penetrates through a recess in the bearing housing and the mounting base plate and stands in a direct functional connection with the rotary latch lock. The pull handle also features a locking mechanism with a cylinder lock by means of which the activation mechanism can be locked. A locking strip of the locking mechanism is brought into a position, by means of a rotation of the cylinder using a suitable key, in which it blocks the movement of the activating handle. An activation of the activating handle is then no longer possible. The locking strip is thereby positioned outside of the bearing housing.

The object of this invention is to make available a pull handle for a vehicle door or lift-gate, in particular a vehicle door or lift-gate of an agricultural vehicle, for example, a tractor or construction machine which is functionally secure and easily attachable to a lock.

The object is attained by a pull handle as described herein.

BRIEF DESCRIPTION OF THE DRAWINGS

In the following section the invention is explained in more detail using drawings. They show.

DETAILED DESCRIPTION OF THE INVENTION

Figure 1:
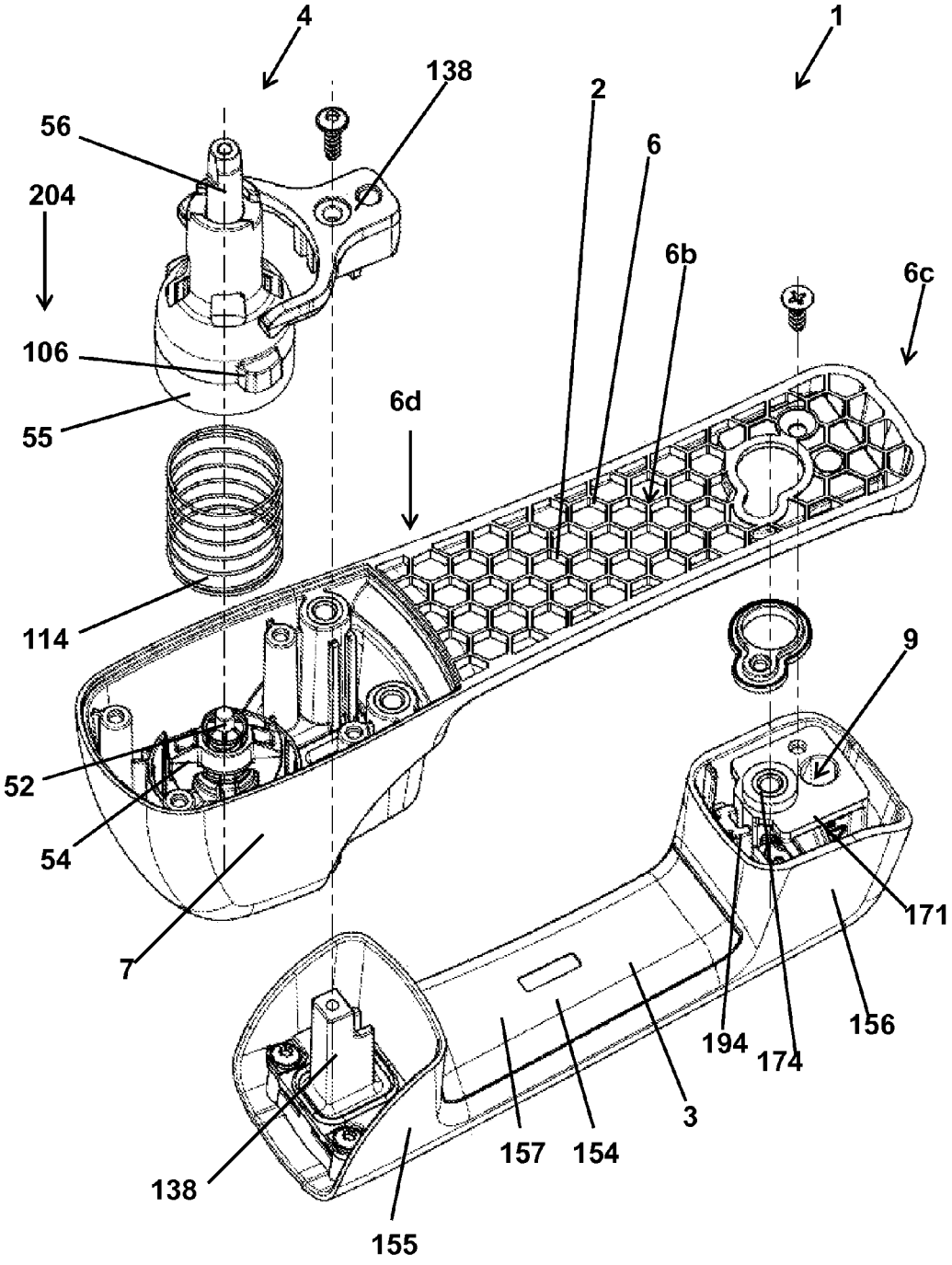
FIG. 1 is an exploded depiction in perspective of the inventive pull handle.

The inventive pull handle 1 (FIGS. 1-3) features a pull handle housing 1*a* with a bearing part 2 and a handle part 3 connected to the bearing part 2 so as to rotate, an activation mechanism 4 positioned in the pull handle housing 1*a* to release the lock, in particular a rotary latch lock, as well as a catch or locking mechanism 5 positioned in the pull handle housing 1*a* to lock the activation mechanism 4 or for decoupling the activation mechanism 4 from the handle part 3. By means of the locking mechanism 5 the activation mechanism 4 is lockable and unlockable such that it is unable to function, so that a pull on the handle part 3 does not cause an unlocking of the lock. This can be achieved in that a coupling element of the activation mechanism 4 which is used for coupling with the lock, is no longer activated, namely the handle part 3 performs a no-load stroke, or because the handle part 3 is locked in its non-activated position.

Figure 7:
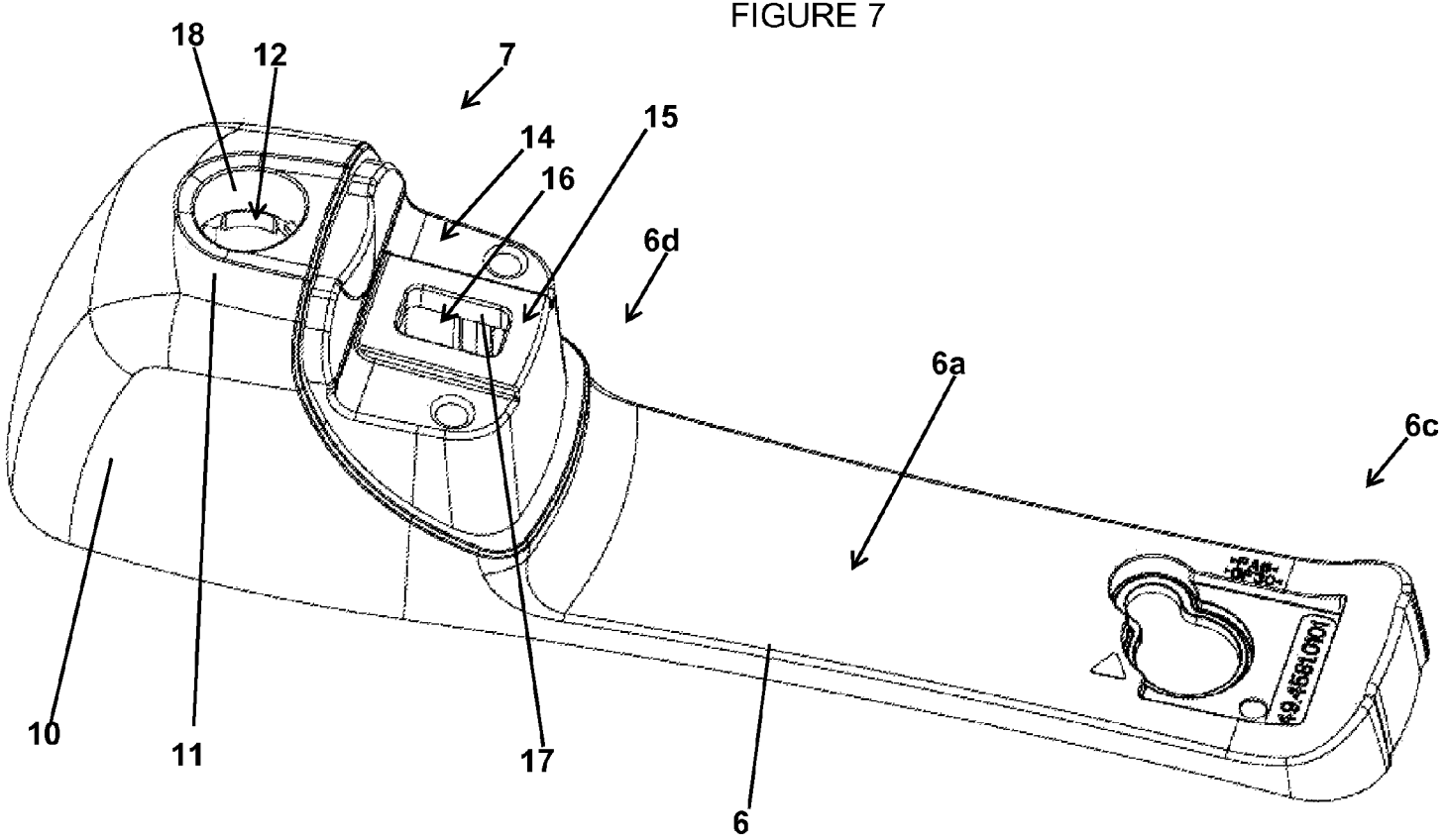
FIG. 7 is a side view of the bearing part in perspective view 3.
Figure 8:
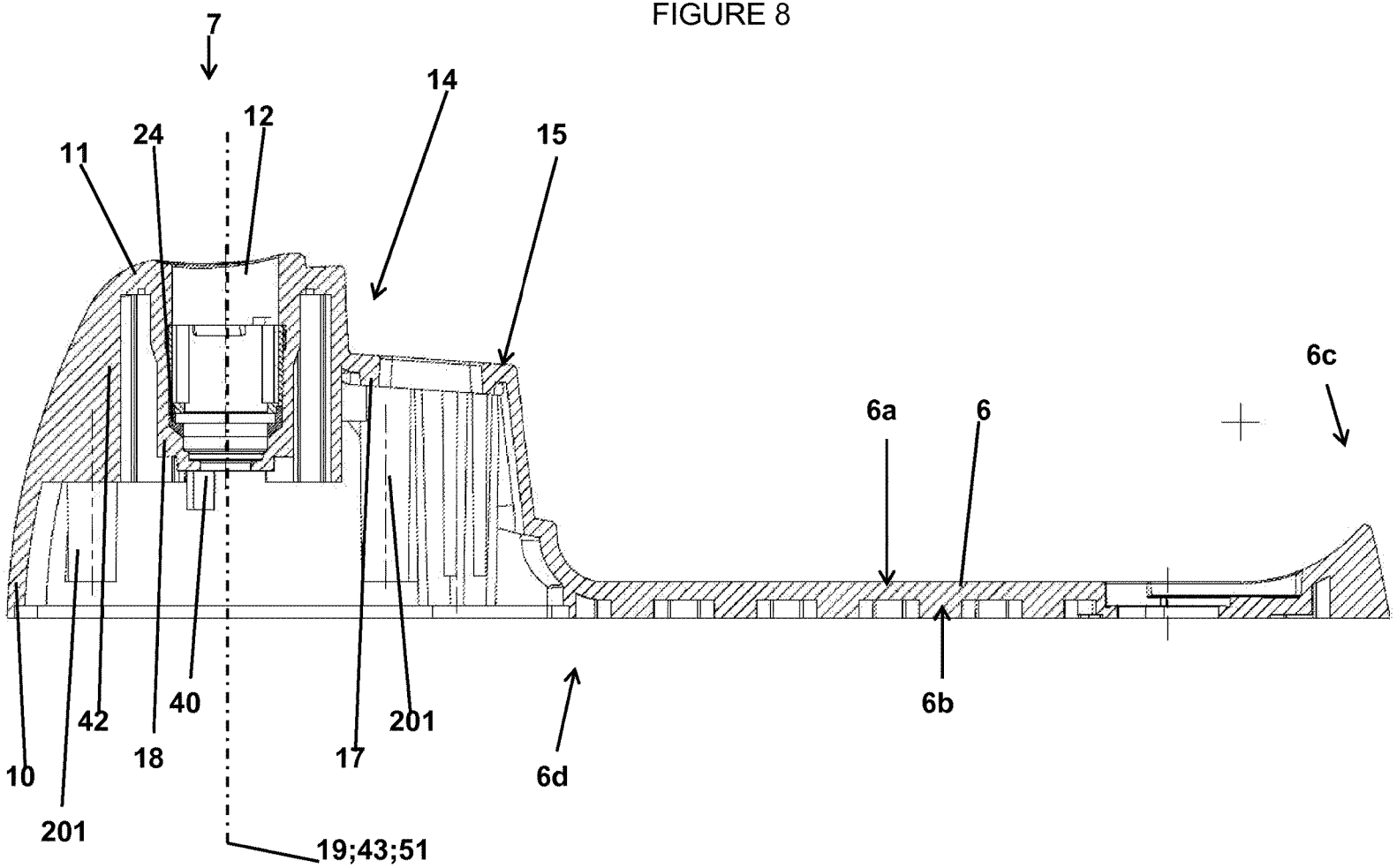
FIG. 8 is a longitudinal cross-sectional view through the bearing part.
Figure 9:
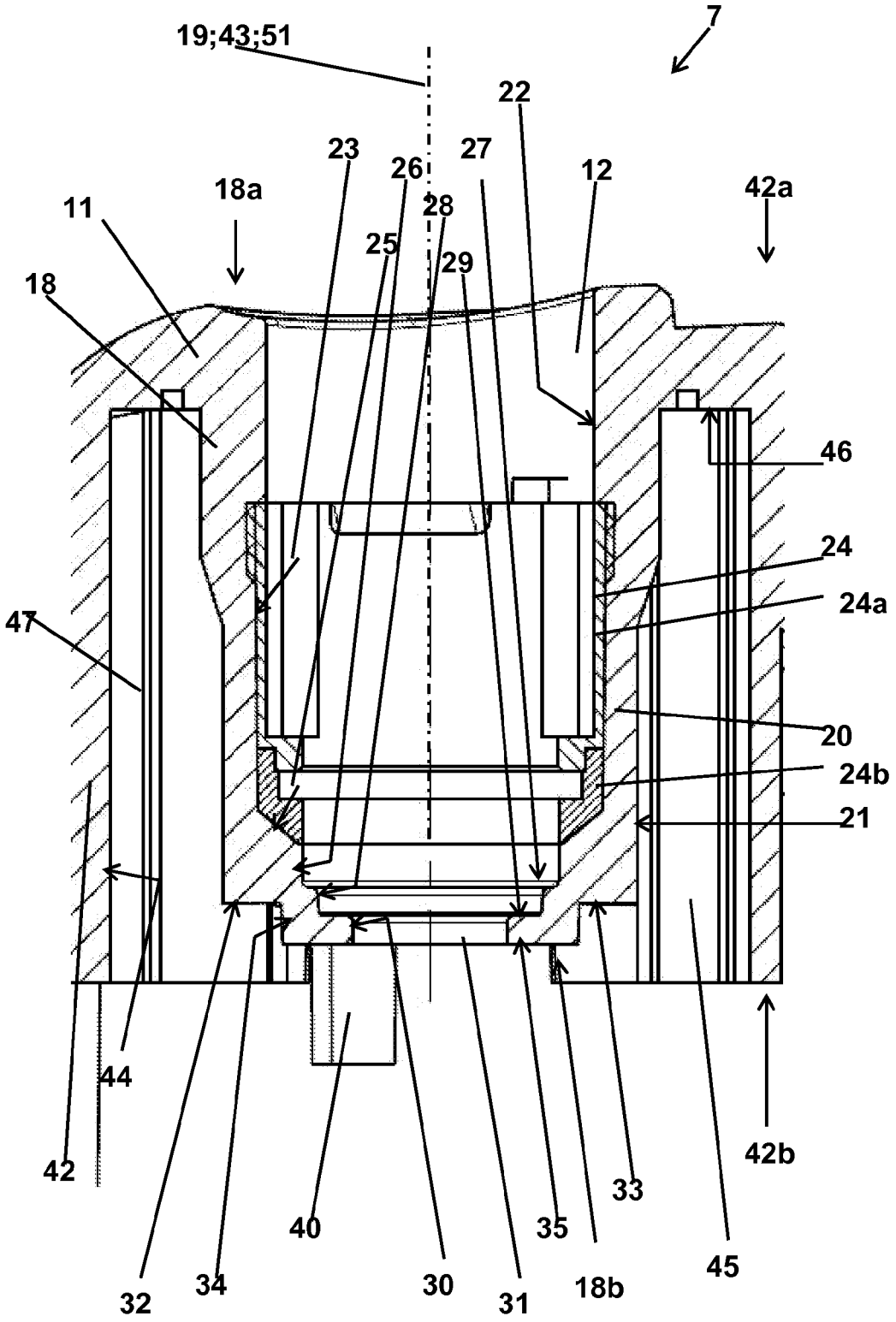
FIG. 9 is an enlargement of a cross-sectional view from FIG. 8 in the area of the bearing housing.

The bearing part 2 (FIGS. 7, 8) features a base plate 6, a bearing housing 7 for mounting the locking mechanism 5, a cover 8, as well as a means 9 to mount the handle part 3.

The base plate 6 features a first base plate top side 6*a* facing the handle part 3 as well as a base plate top side 6*b* facing away from the handle part 3 and opposite the first base plate top side 6*a*. In addition the long base plate 6 features a first plate end 6*c* facing away from the bearing housing 7 and a second plate end 6*d* opposite it and facing the bearing housing 7.

The bearing housing 7 and the base plate 6 are preferably constructed as one-piece and consist of plastic. In addition the bearing housing 7 connects to the base plate 6 at the second plate end 6*d*. Furthermore the bearing housing 7 extends away from the first plate top side 6*a*. The bearing housing 7 is constructed in a beaker-shaped or cup-shaped or dome-shaped manner and features a surrounding circumferential wall 10 attaching to the base plate 6, as well as a housing floor 11. The bearing housing 7 is open opposite the housing floor 11. The housing floor 11 also features a first cylindrical housing opening 12 to accommodate a cylinder lock 13. In addition, the housing floor 11 features a stepped shoulder 14 with an exterior shoulder area 15. The housing floor 11 features in the area of the stepped shoulder 14 a second housing opening 16, in particular rectangular. A ring-shaped, rectangular stop flange 17 connects on the inside to the second housing opening 16. The stop flange 17 is thus positioned inside the bearing housing 7.

The bearing housing 7 furthermore features a bearing bushing 18 which connects to the first housing opening 12 and extends into the bearing housing 7. The bearing bushing 18 thus extends away from the housing floor 11 to the base plate 6. The bearing bushing 18 features a bearing bushing axis 19 which extends away from the housing floor 11 to the base plate 6. The bearing bushing axis 19 extends in particular perpendicular to the base plate 6. The bearing bushing 18 thus features a first bushing end 18*a* on the housing floor side and an opposite bushing end 18*b* turned away from the housing floor 11. The bearing bushing 18 also features a bearing bushing wall 20 with a bushing wall outer area 21 and a bushing wall inner area 22, as well as a bushing wall base area 32.

The bushing wall inner area 22 features a first cylindrical interior area section 23 viewed from the first housing opening 12 in the direction of the bearing bushing axis 19 which serves to mount a locking cylinder 24 of the cylinder lock 13. A conical interior area section 25 connects to the first cylindrical interior area section 23 which tapers in the direction of the bearing bushing axis 19. A second interior section 26 connects to the conical interior area section 25. This merges across a first, flat ring area 27 into a third cylindrical interior area section 28. The third interior area section 28 features a smaller diameter than the second cylindrical interior area section 26. The third cylindrical interior area section 28 furthermore merges across a second flat ring area 29 into a fourth cylindrical interior area section 30. The fourth cylindrical interior area section 30 adjoins a pass-through opening 31.

The bushing wall base area 32 connects to the bushing wall outer area 21 at a second bearing bushing end 18*b*. The bushing wall base area 32 features a ring-shaped latching surface 33 viewed from the bushing wall outer area 21 in the direction of the bushing bearing axis 19. The latching surface 33 thus connects directly to the base wall outer area 21. A cylindrical base area section 34 connects to the latching surface 33. A ring-shaped, flat contact area 35 connects to the cylindrical base area section 34. The flat contact area 35 then connects directly to the fourth cylindrical interior area section 30. In addition the contact area 35 is perpendicular to the bearing bushing axis 19.

The latching surface 33 features two locking sections 36 lying radially opposite in relation to the bearing bushing axis 19. The locking sections 36 respectively exhibit two locking recesses or locking depressions 37 adjacent to each other in the circumferential direction in relation to the bearing bushing axis 19. The locking recesses 37 adjacent to each other transition into each other across a locking elevation 38. The locking recesses 37 and elevations 38 are respectively formed by wedge areas 39 running together in a point.

The bearing bushing 18 also features a spring pin 40 protruding from the latching surface 33 which serves to support a torsion spring 41 which will be explained more below.

The bearing housing 7 also features a bearing sleeve 42 which features a bearing sleeve axis 43. The bearing sleeve axis 43 is coaxial to the bearing bushing axis 19. Furthermore the bearing sleeve 42 is positioned around the bearing bushing 18. The bearing sleeve 42 thus surrounds the bearing bushing 18. An annular gap 45 is thus present between the bearing bushing 18, especially the bearing bushing outer area 21, and the bearing sleeve 42, in particular the bearing sleeve interior area 44. The annular gap 45 is bounded at the housing base 11 by a ring-shaped, especially flat, locating face 46. The bearing sleeve 42 likewise extends away from the housing base 11. As a result the bearing sleeve 42 features a first bearing sleeve end 42*a* on the housing base side and opposite it a second bearing sleeve end 42*b* turned away from the housing base 11.

The bearing sleeve 42 also features several guide ribs 47 separated from each other and positioned adjacent to each other in a circumferential direction in relation to the bearing sleeve axis 43. The guide ribs 47 connect to the cylindrical bearing sleeve interior area 44 and protrude from it radially inward. Furthermore the guide ribs 47 extend from the first to the second bearing sleeve end 42*a*, 42*b* and thus across the entire length of the bearing sleeve 42.

Figure 2:
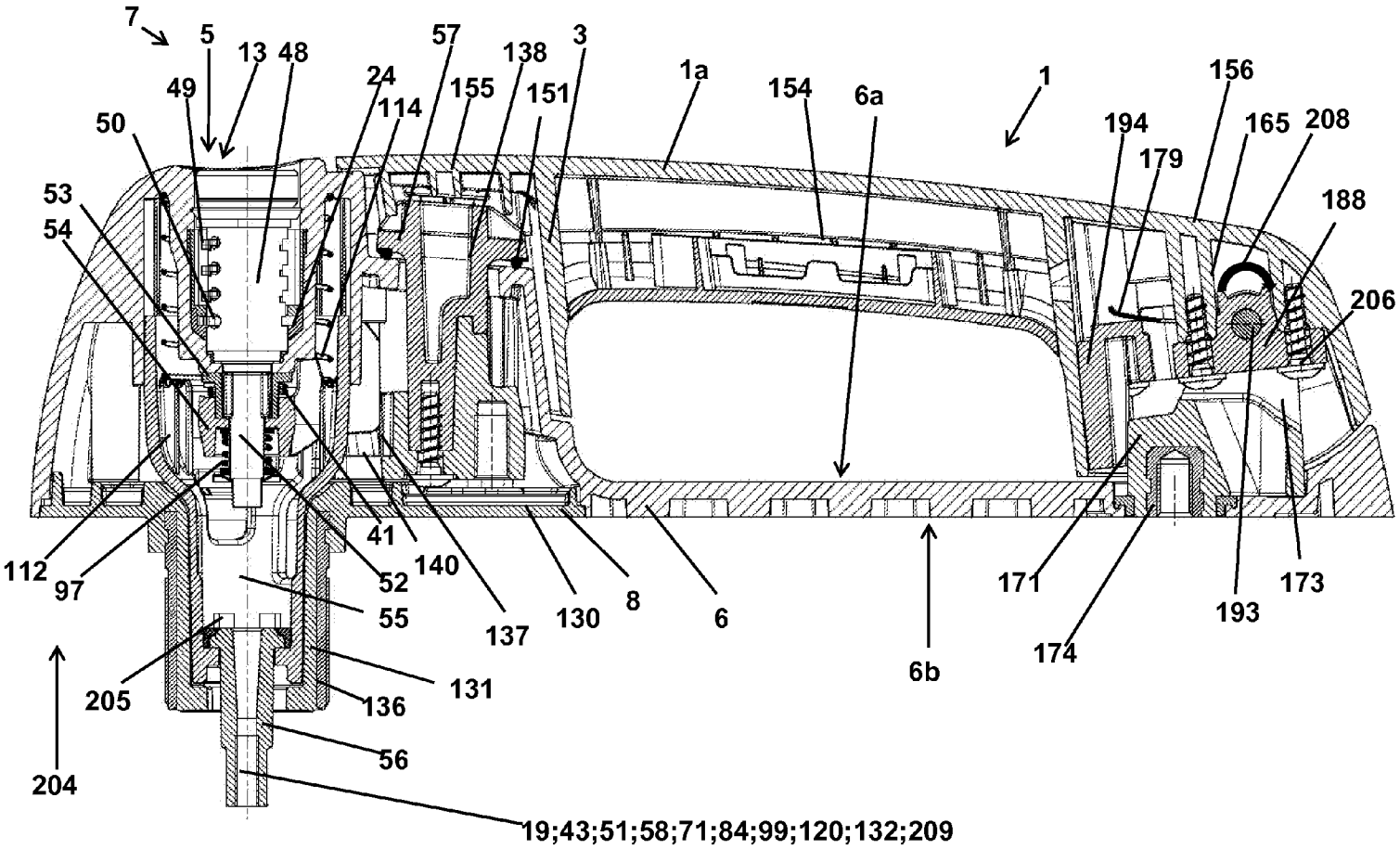
FIG. 2 is a longitudinal cross-sectional view through the pull handle in the non-activated position.
Figure 3:
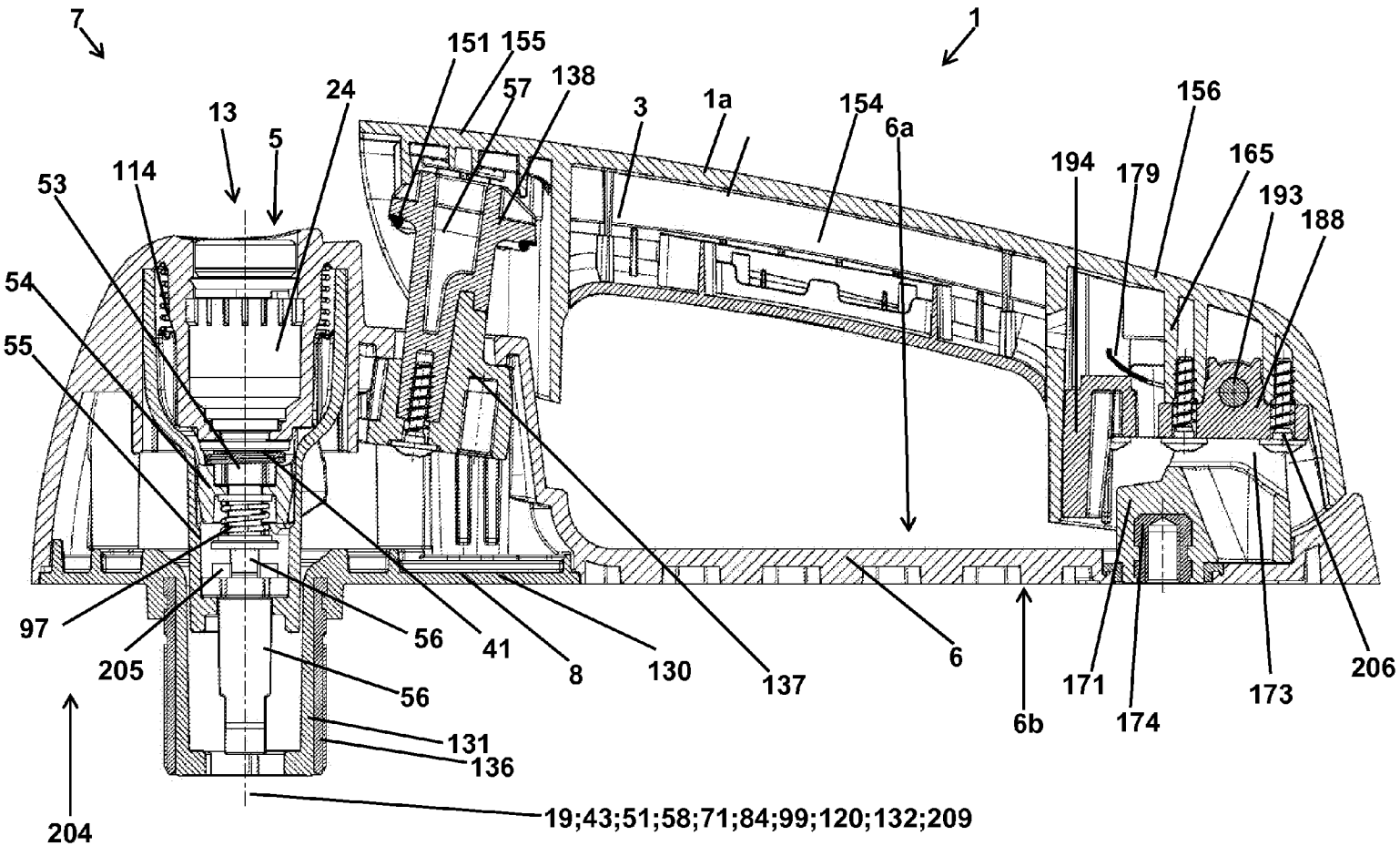
FIG. 3 is a longitudinal cross-sectional view through the pull handle in the activated position.

As already stated above, the inventive pull handle 1 features a locking mechanism 5 with a cylinder lock 13 (FIGS. 2, 3). The cylinder lock 13 features in a known manner the locking cylinder 24 as well as a cylinder core 48 with the spring-loaded, disc tumblers 49 positioned therein and a locking tumbler 50. The locking cylinder 24 features a cylinder axis 51, is preferably constructed in two pieces, and features a first and a second cylinder part 24*a*, 24*b*. The cylinder axis 51 is coaxial to the bearing sleeve axis 19. The two cylinder parts 24*a*, 24*b* are pressed together. Furthermore a ring slot is formed between the two cylinder parts 24*a*, 24*b* into which the locking tumbler 50 engages. As a result, the cylinder core 48 is mounted in the locking cylinder 24 to be axially immovable. The locking cylinder 24 is also molded into the bearing housing 7, namely mounted in it so as not to displace or rotate. The locking cylinder 24 is thereby positioned inside the bearing bushing 18 and rests on the first cylindrical interior area section 23 and the conical interior area section 25.

The cylinder core 48 is positioned in a known manner inside the locking cylinder 24. If no appropriate key is inserted into the cylinder core 48, the disc tumblers 49 are pressed by means of springs into grooves of the locking cylinder 24, so that the cylinder core 48 cannot be rotated around the cylinder axis 51. If an appropriate key is inserted, the disc tumblers 49 are drawn into the cylinder core 48 so that the cylinder core 48 can be rotated in the locking cylinder 24 around the cylinder axis 51. This occurs in a known manner.

The locking mechanism 5 also features an adapter pin 52, a follower sleeve 53 and a locating sleeve 54.

Figure 11:
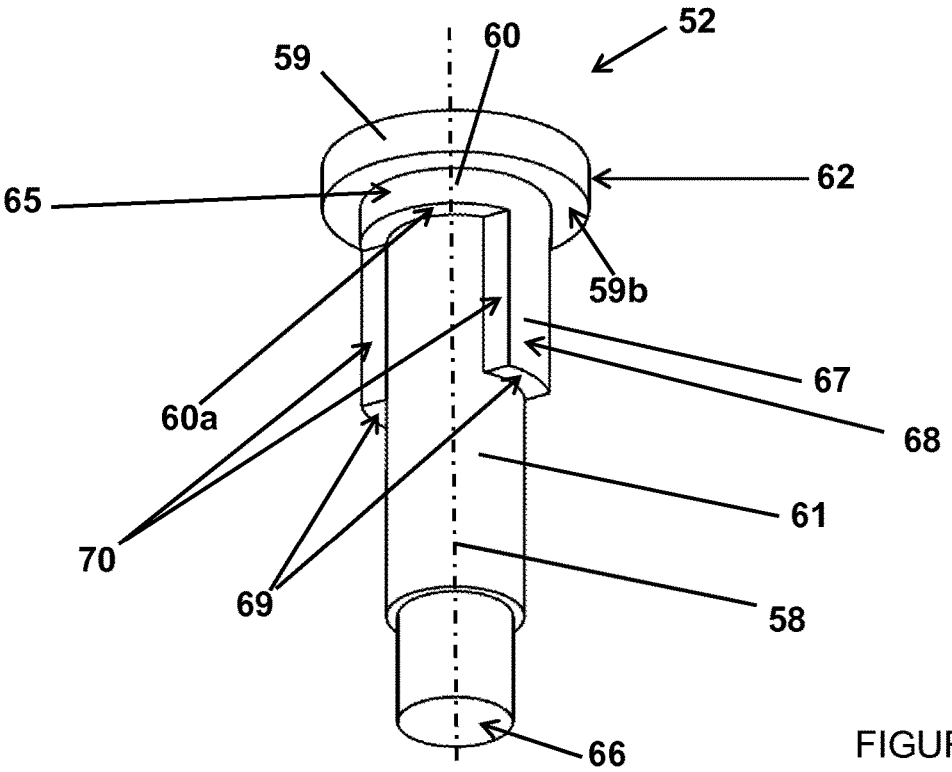
FIG. 11 is a first perspective view of an adapter pin.
Figure 12:
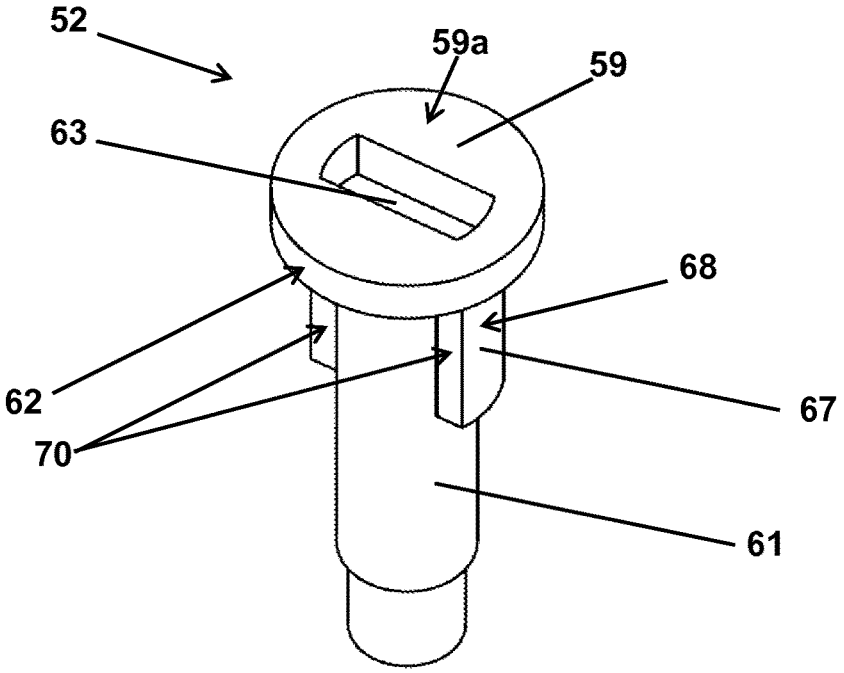
FIG. 12 is another perspective view of the adapter pin.

In order to transfer the turning movement of the cylinder core 48 or move it further on, the adapter pin 52 (FIGS. 11, 12) is present. The adapter pin 52 preferably consists of metal, especially of zinc, and is produced in particular by die-casting. The adapter pin 52 features a longitudinal extension in the direction of an adapter pin longitudinal axis 58 which is coaxial to the cylinder axis 51. Furthermore, the adapter pin 52 features an adapter pin head 59, an adapter pin collar 60 connecting to the adapter pin head 59, and an adapter pin shaft 61 connecting to the adapter pin collar 60. Thus the adapter pin 52 features a head end or an adapter pin drive end 52*a* and a foot end 52*b* opposite the head end 52*a* viewed in the direction of the adapter pin long axis 58. The adapter pin head 59 features a head top side 59*a* which is advantageously constructed as level. In addition, the adapter pin head 59 features a surrounding, cylindrical, barrel-shaped, head edge surface 62 and an advantageously level, head lower side 59*b* opposite the head top side 59*a*. The head top side 59*a* and the head lower side 59*b* are preferably perpendicular to the adapter pin longitudinal axis 58. In addition the adapter pin head 59 features a drive slot 63 which protrudes from the head top side 59*a* into the adapter pin head 59. The drive slot 63 is used to couple with the cylinder core 48. The latter features a drive pin 64 on its end facing the adapter pin 52 which positively engages into the drive slot 63.

The adapter pin collar 60 connects to the head lower side 59*b* of the adapter pin head 59 and features a surrounding, cylindrical, barrel-shaped collar edge area 65 and an advantageously level collar lower side 60*a* opposite the head lower side 59*b*. The collar lower side 60*a* is preferably perpendicular to the cylinder axis 51 and the adapter pin axis 58. The diameter of the collar edge area 65 is smaller than the diameter of the head edge area 62.

The adapter pin shaft 61 is constructed cylindrically and forms the foot end 52*b* on its end turned away from the adapter pin collar 60. Furthermore the adapter pin shaft 61 features a cylindrical shaft exterior area 61*a* which preferably tapers slightly across a shoulder at the foot end 52*b* lying opposite the head end 52*a*. The diameter of the shaft exterior area 61*a* is smaller than the diameter of the collar edge area 65. At the foot end 52*b* the adapter pin shaft 61 features an advantageously level end area 66 perpendicular to the adapter pin long axis 58.

The adapter pin 52 also features two driving ribs 67 lying radially opposite in relation to the adapter pin long axis 58. The driving ribs 67 connect directly to the collar lower side 60*a* and also extend radially in the longitudinal direction of the adapter pin long axis 58. They are thus cylinder tube sections. The driving ribs 67 protrude from the adapter pin shaft 61 in the radial direction. The driving ribs 67 feature a cylindrical rib exterior area 68 whose diameter preferably corresponds to the diameter of the collar edge area 65. The driving ribs 67 preferably do not extend across the entire length of the adapter pin shaft 61. As a result, they exhibit a rib end area 69 on their end turned away from the adapter pin collar 60. The rib end area 69 is preferably constructed level and perpendicular to the adapter pin long axis 58. Furthermore, the driving ribs 67 feature two preferably level, rib edges 70 radially limiting the driving ribs 67. The rib edges 70 extend parallel to the adapter pin long axis 58.

Figure 13:
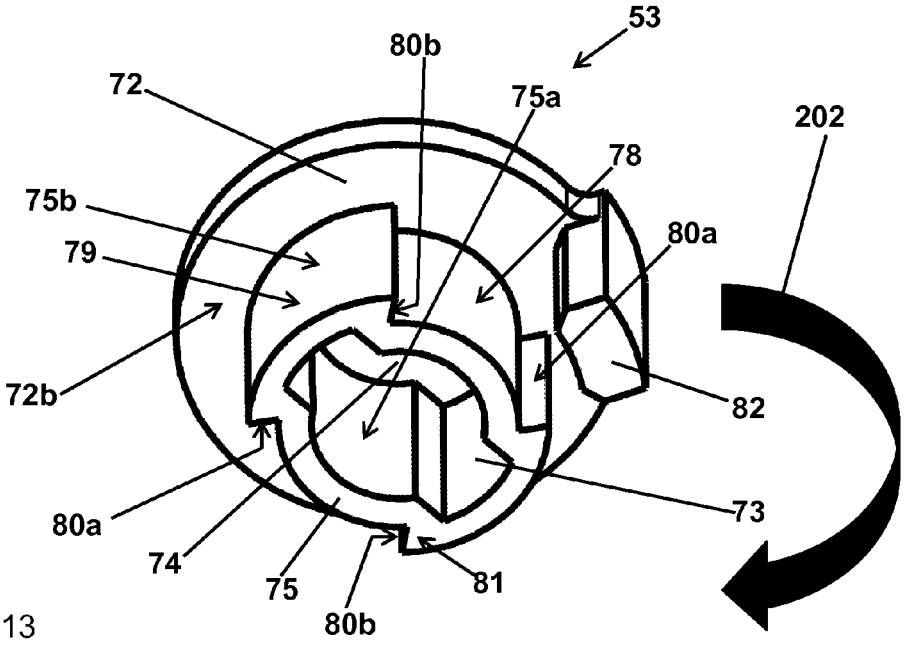
FIG. 13 is a perspective view of the follower sleeve.
Figure 14:
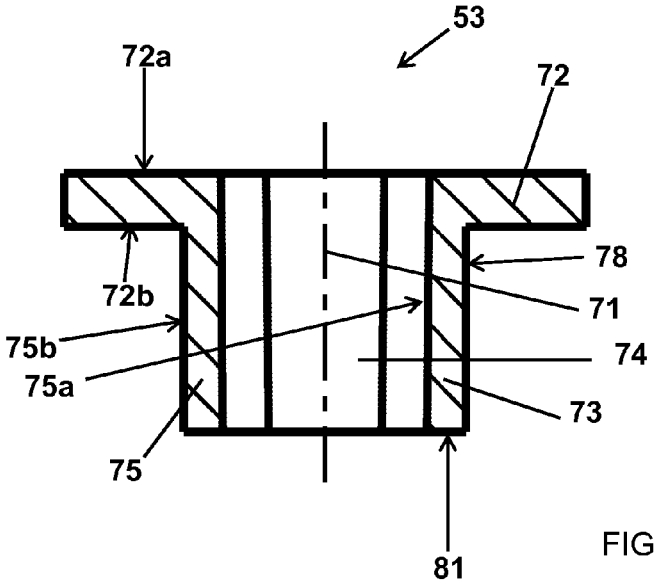
FIG. 14 is a longitudinal cross-sectional view through the follower sleeve.

The follower sleeve or driving bushing 53 (FIGS. 13, 14) serves to convey the rotation movement of the adapter pin 52 to the locating sleeve 54. It consists preferably of metal, in particular zinc, and was produced in particular by die-casting. The follower sleeve 53 features a longitudinal extension in the direction of the follower sleeve axis 71 which is coaxial to the adapter pin long axis 58. In addition, the follower sleeve 53 features a head panel and a pipe-shaped or sleeve-shaped, sleeve shaft 73 connecting to the head panel 72. The head panel 72 features a panel top side 72*a* and a panel lower side 72*b* lying opposite it. The panel top side 72*a* and the panel lower side 72*b* are level and perpendicular to the follower sleeve axis 71. The sleeve shaft 73 connects to the panel lower side 72*b* and extends away from it. In addition the follower sleeve 53 features a sleeve recess 74 penetrating through the follower sleeve 53 in the direction of the follower sleeve long axis 71. The cross-sectional shape of the sleeve recess 74 corresponds to the cross-sectional shape of the adapter pin shaft 61 in the area of the driving ribs 67.

Figure 4:
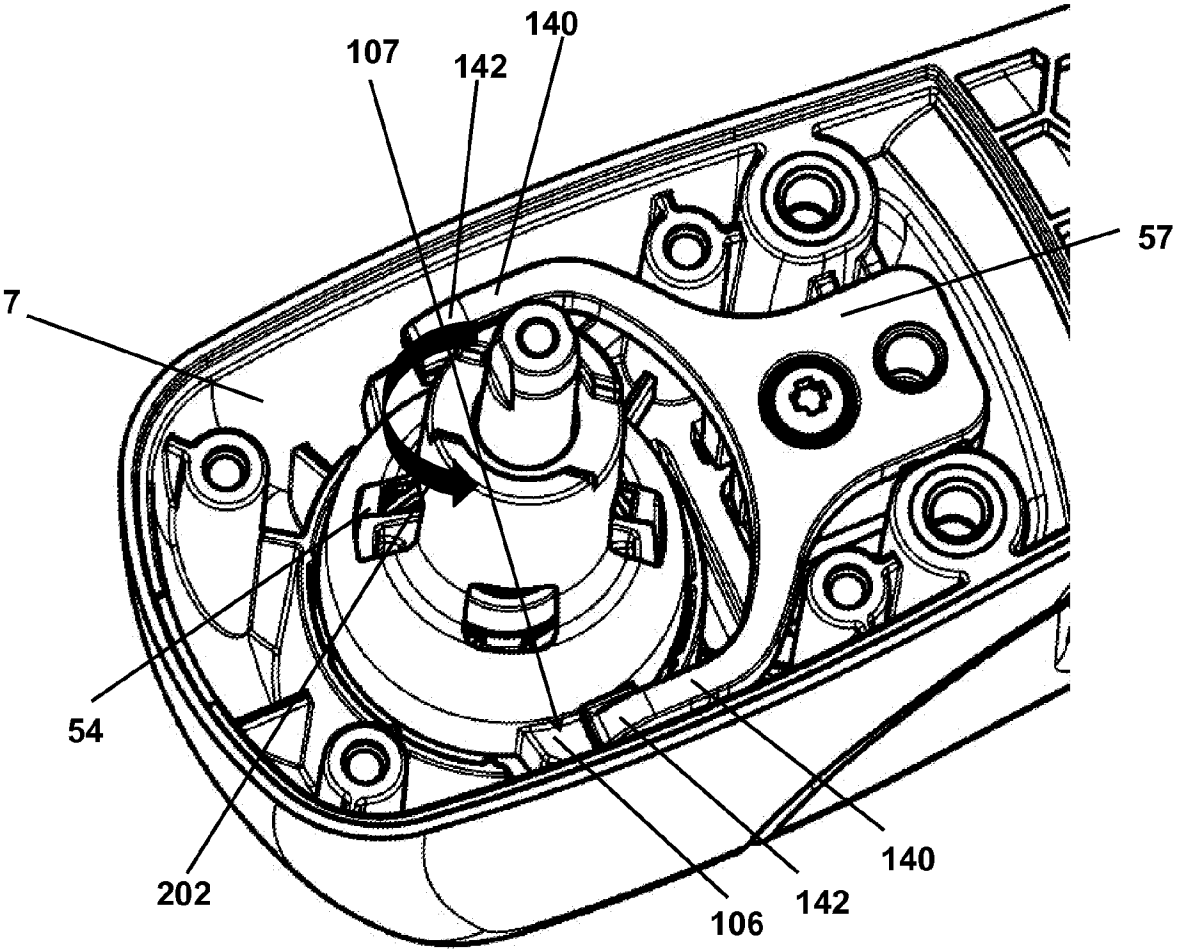
FIG. 4 is an overhead view of a part of the activation mechanism in the coupled or unlocked and activated position.

The sleeve shaft 73 features a pipe-shaped shaft wall 75 with a shaft wall exterior area 75*b* and a shaft wall interior area 75*a*. Since the shaft wall interior area 75*a* limits the sleeve recess 74, the profile of the shaft wall interior area 75*a* likewise corresponds to the cross-sectional shape of the adapter pin 61 in the area of the driving ribs 67. The shaft wall exterior area 75*b* features two first guide areas 78 lying radially opposite in relation to the follower sleeve long axis 71. The first guide areas 78 are constructed as cylindrically shaped segment areas. They are also constructed rotationally symmetrical to the follower sleeve long axis 71 and form segments of an exterior jacket area of a circular cylinder. In addition, the shaft wall exterior area 75*b* features two second guide areas 79 likewise lying radially opposite in relation to the follower sleeve long axis 71. The second guide areas 79 are likewise constructed as cylindrically shaped segment areas. They are also constructed rotationally symmetrical to the follower sleeve long axis 71. In any event the diameter of the second guide areas 79 is greater than the diameter of the first guide areas 78. As a result, the second guide areas 79 are displaced radially outward in relation to the first guide areas 78. In this respect the first guide areas 78 are positioned between the second guide areas 79 viewed in the circumferential direction. An activation area 80*a,b* is present between the first and second guide areas 78, 79 across which the guide areas 78, 79 go into each other. Overall there are thus four activation areas 80*a,b*, namely two first activation areas 80*a* and two second activation areas 80*b*. The first activation areas 80*a* serve to lock and the second activation areas 80*b* serve to unlock, whereupon more will be said below. The first activation areas 80*a* extend in a locking direction 202 (FIGS. 4, 13) viewed from one of the first guide areas 78 to the adjacent second guide area 79 displaced outward. The second activation areas 80*b* extend in the locking direction 202 when viewed from one of the second guide areas 79 to the first guide area 78 adjacent thereto and displace inward. Meant by "viewed in the locking direction 202" is that the shaft wall exterior area 75*b* is pulled out in the direction of locking 202. The preferably level activation areas 80*a,b* also extends in a radial direction and parallel in relation to the follower sleeve long axis 71.

The sleeve shaft 73 of the follower sleeve 53 also features a preferably level shaft end area 81 lying opposite to the head panel 72. The shaft end area 81 is preferably perpendicular to the follower sleeve long axis 71. In addition the follower sleeve 53 features a spring pin 82 which protrudes from the panel lower side 72*b* and is separated from the shaft wall exterior area 75*b*.

Figure 15:
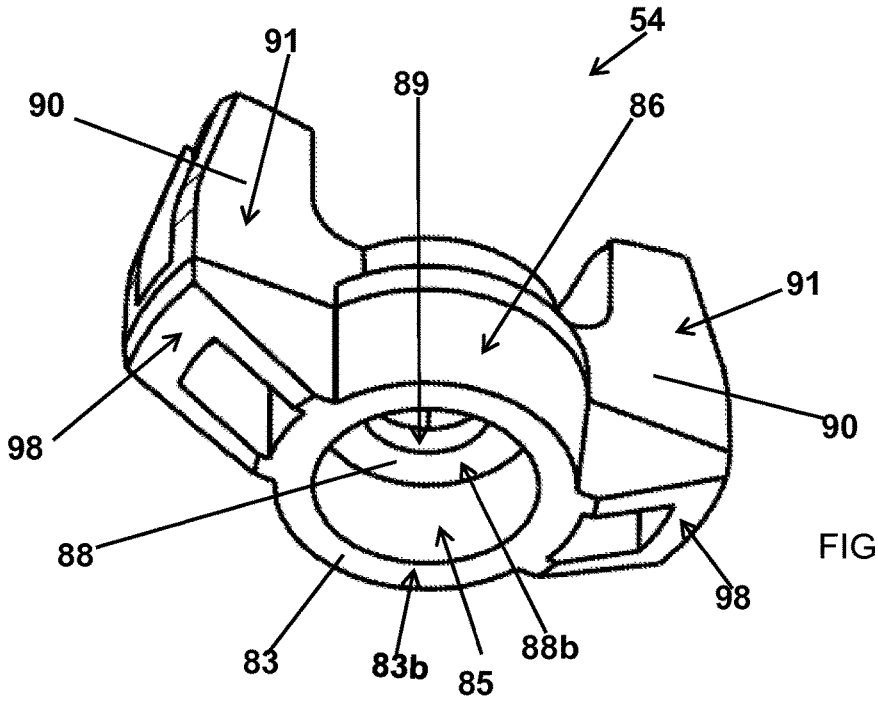
FIG. 15 is a first perspective view of a locating sleeve.
Figure 16:
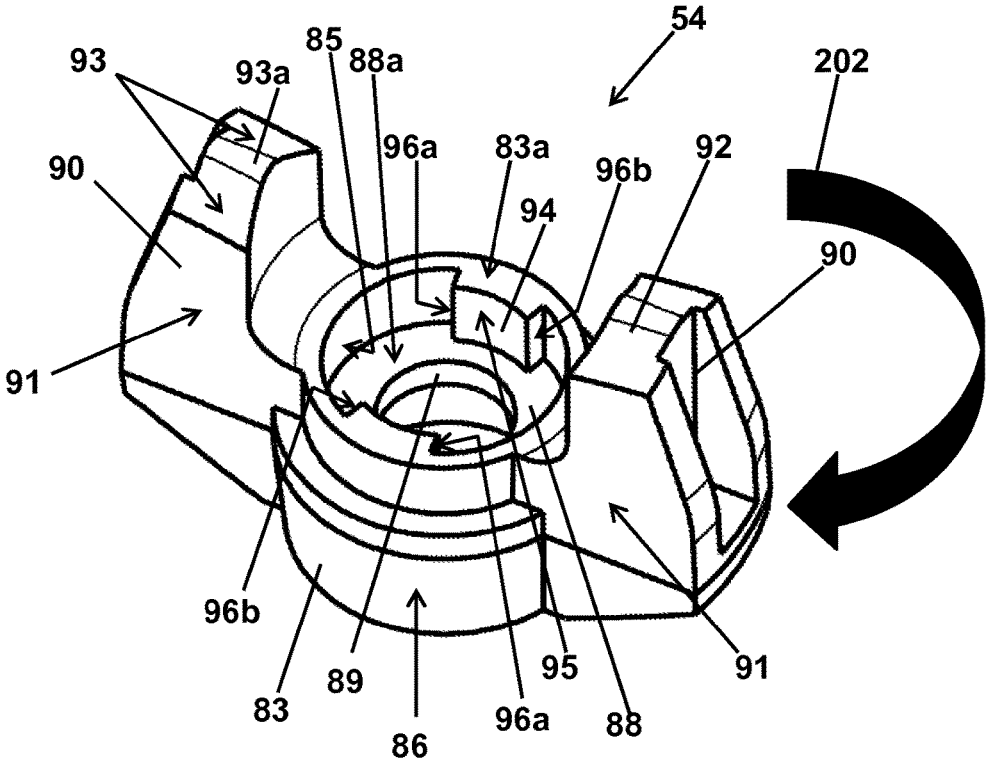
FIG. 16 is another perspective view of the locating sleeve.
Figure 17:
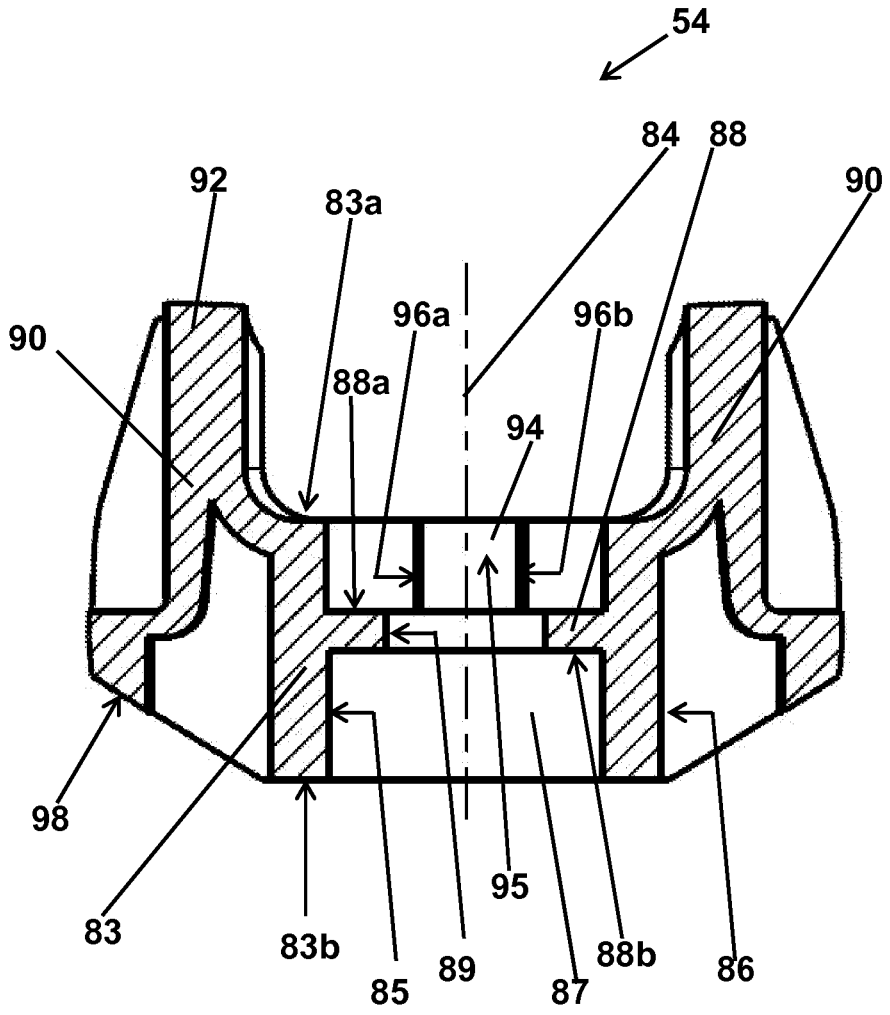
FIG. 17 is a longitudinal cross-sectional view through the locating sleeve.

The locating sleeve 54 (FIGS. 15-17) serves to convey the rotation movement of the follower sleeve 53 to a coupling sleeve 55 of the activation mechanism 4. The locating sleeve 54 features a locating sleeve wall 83 as well as a locating sleeve axis 84 which is coaxial to the cylinder axis 51. The pipe-shaped locating sleeve wall 83 features a circular cylindrical wall interior area 85 and a circular cylindrical wall exterior area 86. The wall interior area 85 bounds a recess 87 passing through the locating sleeve 54 in the direction of the locating sleeve axis 84. The diameter of the wall interior area 85 corresponds to the diameter of the second guide areas 79 of the follower sleeve 53. Furthermore, the sleeve wall 83 features a first, ring-shaped and preferably level wall end area 83*a* and a second, ring-shaped and preferably level, wall end area 83*b*. In addition the locating sleeve 54 features a ring collar 88. The ring collar 88 connects to the wall interior area 85 and extends from it radially inward to the locating sleeve axis 84. The ring collar 88 features a first ring collar surface 88*a* facing the first wall end area 83*a* and a second ring surface 88*b* facing the second wall end area 83*b*. The ring collar 88 also features a circular cylindrical ring interior area 89. The ring collar 88 is positioned preferably centered between the first and the second wall end area 83*a*, 83*b*.

The locating sleeve 54 also features two latching arms 90 which are formed on the wall exterior area 86 and protrude from it. The latching arms 90 feature a longitudinal extension parallel to the locating sleeve axis 84. The two latching arms 90 are positioned radially opposite in relation to the locating sleeve axis 84. Furthermore the latching arms 90 connect to the wall exterior areas 86 in the area of the second wall end area 83*b* and extend to the first wall end area 83*a* and across it. In addition, the two latching arms 90 exhibit two slide surfaces 91 parallel to each other. The slide surfaces 91 are constructed level and extend parallel to the locating sleeve axis 84. All four slide surfaces 91 are preferably parallel to each other. The slide surfaces 91 are preferably perpendicular to the wall end areas 83*a*, 83*b*. On their free ends the latching arms 90 feature a detent 92. This detent 92 features two wedge areas 93 which run together in a point and transition into each other across a locking edge 93*a*. Each of the latching arms 90 features a locating surface 98 on its end opposite the detent 92.

The locating sleeve 54 also features two radially opposite driving ribs 94. The driving ribs 94 connect directly to the wall interior area 85 and also extend radially in the longitudinal direction of the locating sleeve axis 84. They are thus circular cylindrical pipe segments. The driving ribs 94 protrude from the wall interior area 85 inward in a radial direction. The driving ribs 94 also connect to the first ring collar surface 88*a* and extend to the first wall end area 83*a* and terminate flush with it. The driving ribs 94 feature a circular cylindrical rib interior area 95 whose diameter corresponds to the diameter of the first guide areas 78. Furthermore, the driving ribs 94 feature two preferably level, first and second rib edges 96*a,b* radially limiting the driving ribs 94. The rib edges 96*a, b* extend parallel to the locating sleeve axis 84 and in a radial direction in relation to the locating sleeve axis 84. Overall there are thus four rib edges 96*a,b*, namely two first rib edges 96*a* and two second rib edges 96*b*. The first rib edges 96*a* serve to lock and the second rib edges 96*b* serve to unlock, and more explanations will be given below. The first rib edge 96*a* is the first rib edge 96*a* of the driving rib 94 viewed in the locking direction 202; the second rib edge 96*b* of the driving rib 94 is downstream from the first rib edge 96*a* of the driving rib 94 in the locking direction 202.

In the assembled state the bearing shaft 73 of the follower sleeve 53 is so positioned in the recess 87 that the shaft end area 81 rests on the first ring collar surface 88*a*. In addition the two guide areas 79 of the follower sleeve 53 rest on the wall interior area 85 of the locating sleeve 54. And the first guide areas 78 of the follower sleeve 53 rest on the rib interior areas 95 of the driving ribs 94. And the activation areas 80*a,b* of the follower sleeve 53 are positioned between the rib edges 96*a,b* of the driving ribs 94 when viewed in the circumferential direction in relation to the locating sleeve axis 84.

The separation of the rib edges 96*a,b* viewed in the circumferential direction from the driving ribs 94 adjacent to each other in the circumferential direction, is larger than the extension of the second guide areas 79 in the circumferential direction. And the separation of the rib edges 96*a,b* of a driving rib 94 viewed in the circumferential direction is smaller than the extension of the first guide area 78 in the circumferential direction. As a result a play or free-wheel with respect to the rotation movement around the cylinder axis 51 is present between the follower sleeve 53 and the locating sleeve 54. That means the locating sleeve 54 and the follower sleeve 53 are rotatable with respect to each other by a limited amount around the cylinder axis 51, and more explanations will be provided below. In particular the free-wheel amounts, namely the amount by which the follower sleeve 53 and the locating sleeve 54 rotate relative to each other, is 40 to 50°, preferably 45°.

In the installed state the detents 92 are positioned in locking depressions 37, and again, more information will be provided below.

As already described above the inventive pull handle 1 also features an activation mechanism 4 to activate a lock. The activation mechanism 4 features the coupling sleeve 55, a coupling pin 56 as well as a driving fork 57.

Figure 18:
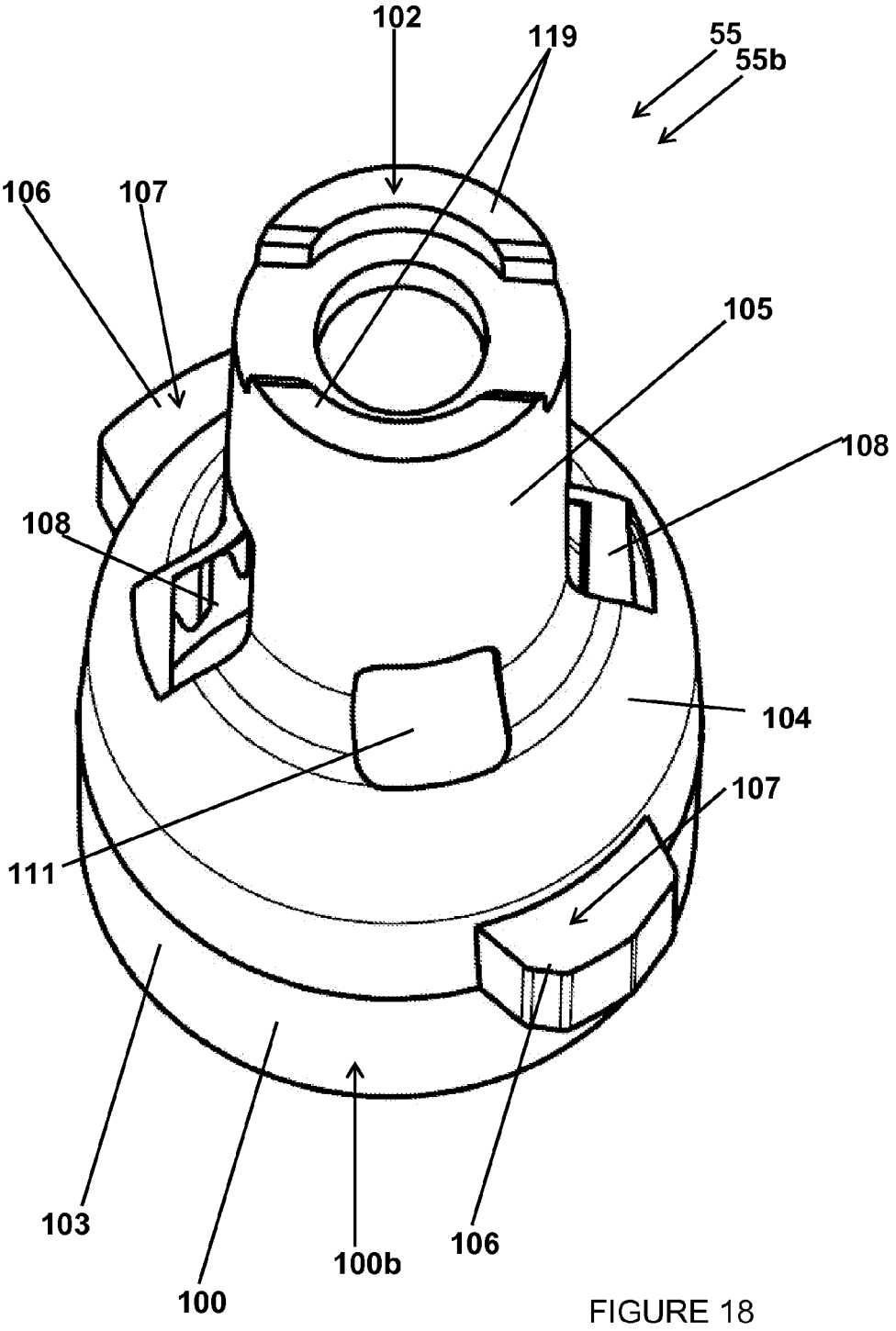
FIG. 18 is a first perspective view of a coupling sleeve.
Figure 19:
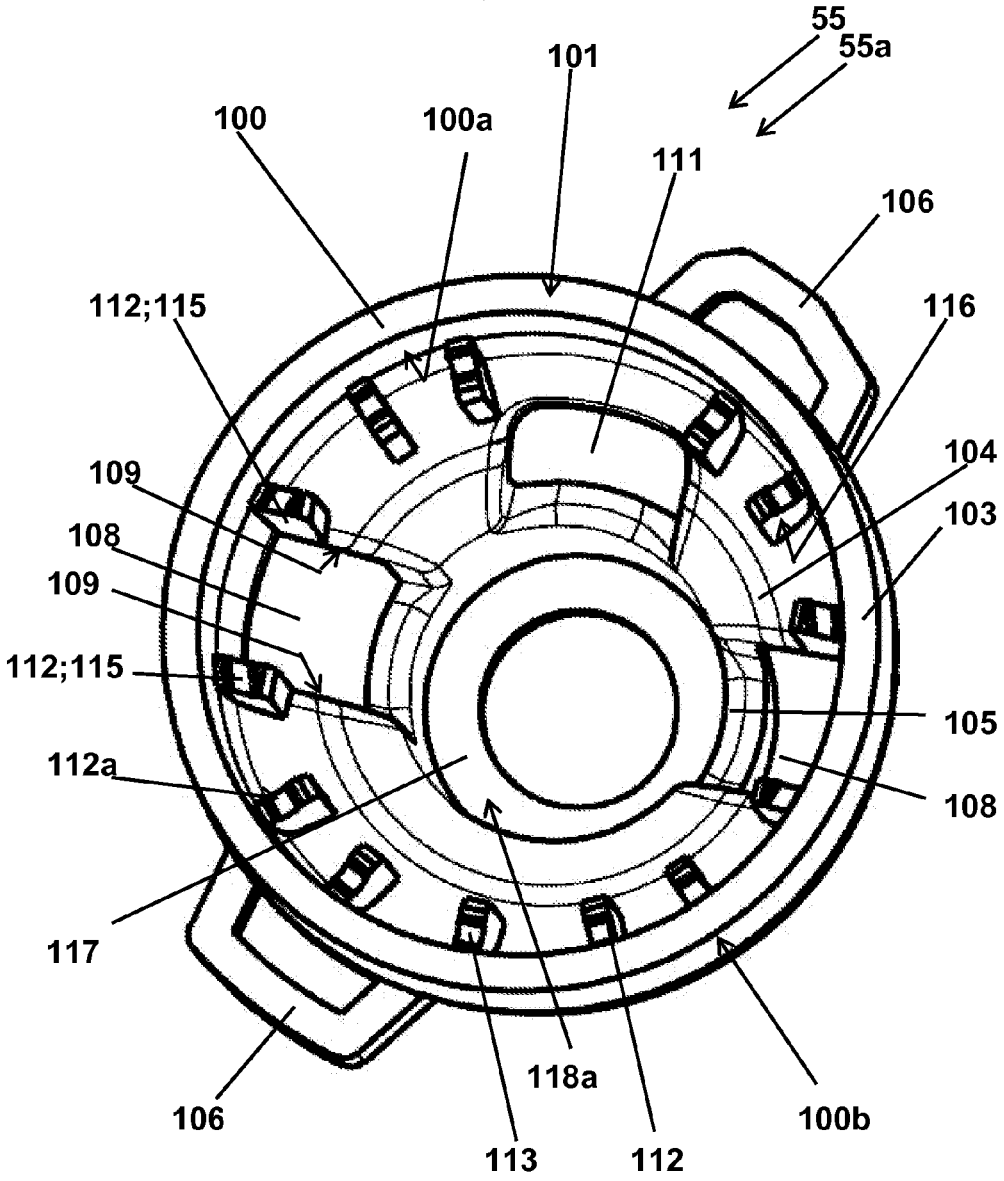
FIG. 19 is another perspective view of the coupling sleeve.
Figure 20:
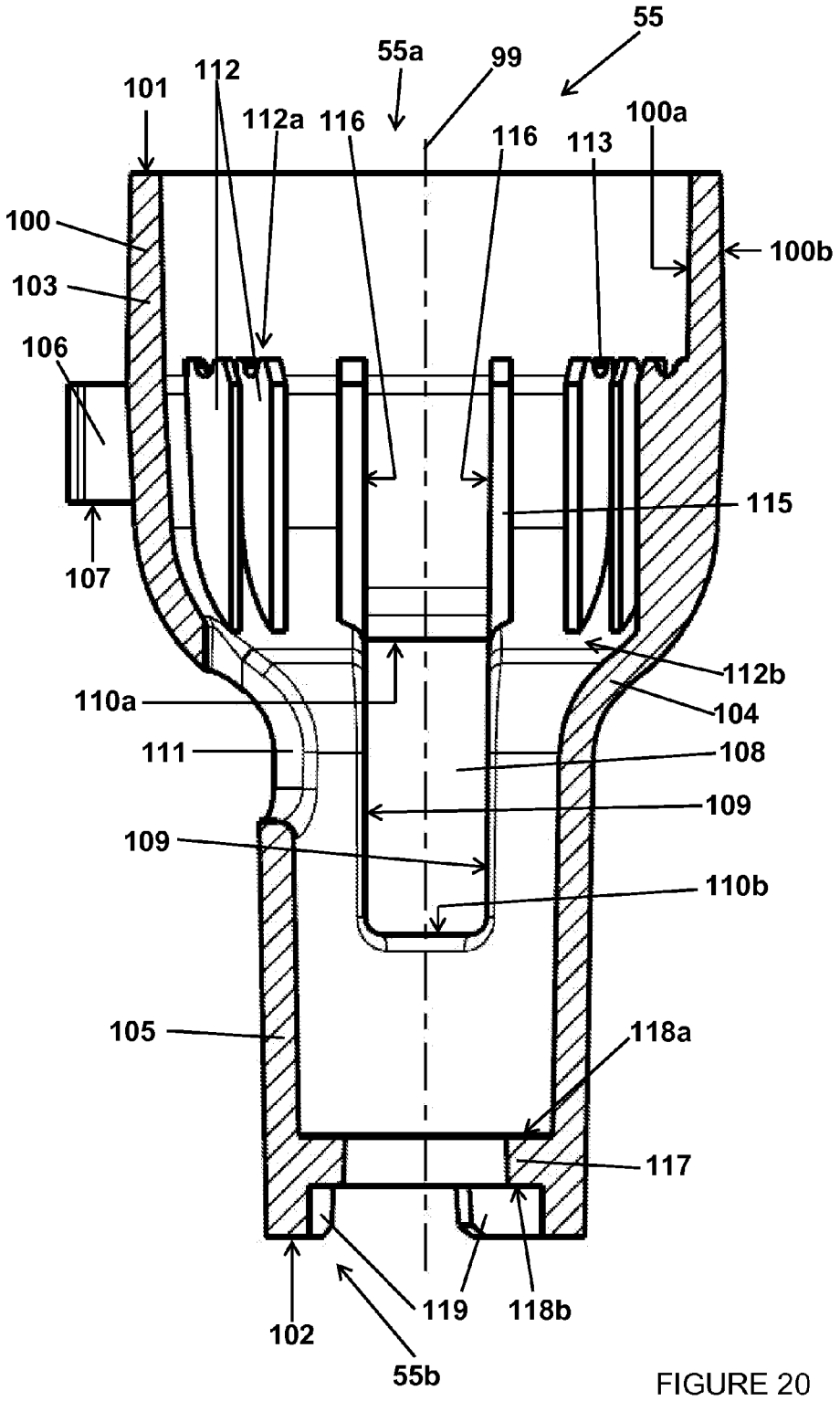
FIG. 20 is a longitudinal cross-sectional view through the coupling sleeve.

The coupling sleeve 55 (FIGS. 18-20) consists preferably of plastic and features a longitudinal extension in the direction of the coupling sleeve long axis 99 which is coaxial to the cylinder axis 51. Furthermore, the coupling sleeve 55 features a first coupling sleeve end 55*a* and a second coupling sleeve end 55*b* opposite thereto. The pipe-shaped coupling sleeve 55 also features a coupling sleeve wall 100 with a wall interior area 100*a* and a wall exterior area 100*b*.

At the first coupling sleeve end 55*a* the coupling sleeve wall 100 features a first, preferably level, ring-shaped end area 101 which preferably is perpendicular to the coupling sleeve long axis 99. At the second coupling sleeve end 55*b* the coupling sleeve wall 100 features a second, preferably level, ring-shaped end area 102 which likewise preferably is perpendicular to the coupling sleeve long axis 99. In addition the coupling sleeve wall 100 next features a circular cylindrical bearing section 103 viewed from a first coupling sleeve end 55*a* in the direction of the coupling sleeve long axis 99. A transition section 104 connects to the circular cylindrical bearing section 103. The coupling sleeve wall 100 tapers in the area of the transition section 104 to the coupling sleeve long axis 99. That means the outer diameter and the inner diameter of the coupling sleeve wall 100 decrease. A circular cylindrical guide section 105 connects to the transition section 104.

The coupling sleeve 55 also features two coupling pins 106 preferably radially opposite in relation to the coupling sleeve long axis 99. The coupling pins 106 connect to the wall outer area 100*b* of the coupling sleeve wall 100 and protrude from it in a radial direction. The coupling pins 106 feature a coupling area 107 facing the second coupling sleeve end 55*b* which preferably is level and perpendicular to the coupling sleeve long axis 99. In addition the coupling pins 106 are positioned in the area of the bearing section 103 at a distance from the first coupling sleeve end 55*a*.

Furthermore the coupling sleeve 55 features two guide slots 108 radially opposite in relation to the coupling sleeve long axis 99. The guide slots 108 begin in the transition area 104 and extend into the guide section 105. The guide slots 108 serve to convey the rotation movement from the locating sleeve 54 to the coupling sleeve 55. The coupling sleeve 55 is also guided. The guide slots 108 feature two side guide edges 109, preferably level, opposite and parallel to each other, as well as two slot end edges 110*a,b*. The first slot end edge 110*a* is facing the first coupling sleeve end 55*a* and the second slot edge 110*b* is facing the second coupling sleeve end 55*b*. In this respect the second slot end edge 110*b* is spaced at a distance from the second coupling sleeve end 55*b*.

The coupling sleeve 55 also features a window 111 passing through the coupling sleeve wall 100. The window 111 is positioned between both guide slots 108 viewed in the circumferential direction of the coupling sleeve 55. In addition the window 111 likewise begins in the transition section 104 and extends into the guide section 105. Indeed the window 111 does not extend so far into the guide area 105 as the guide slot 108. The window 111 serves to accommodate the two spring pins 40, 82.

In addition the coupling sleeve 55 features several ribs 112 distributed in the circumferential direction of the coupling sleeve 55. The ribs 112 connect to the wall interior area 100*a* of the coupling sleeve wall 100 and protrude from it in a radial direction. The ribs 112 begin in the bearing section 103 and extend into the transition section 104. Furthermore, the ribs 112 feature a first rib end 112*a* facing the first coupling sleeve end 55*a* and a second rib end 112*b* facing the second coupling sleeve end 55*b*. At the first rib end 112*a* the ribs 112 feature a receiving trough 113 to receive a first pressure spring 114. The first rib end 112*a* is separated from the first coupling sleeve end 55*a*. The second rib end 112*b* lies at the elevation of the first slot edge 110*a*. In addition two ribs 112 are positioned aligned with the guide edges 109 of the guide slot 108 viewed in the direction of the coupling sleeve long axis 99. These ribs 112 form the guide ribs 115 which serve to guide the coupling sleeve 55 through the locating sleeve 54. The two guide ribs 115 feature a level guide area 116. The guide areas 116 of the guide ribs 15 corresponding to each other are facing each other and parallel to each other.

On its second coupling sleeve end 55*b* the coupling sleeve 55 also features a ring-shaped bearing shoulder 117 protruding into the interior of the coupling sleeve 55. The bearing shoulder 117 connects to the wall interior area 100*a* of the coupling sleeve wall 100 and protrudes radially inward from it. The bearing shoulder 117 features a first, level shoulder area 118*a* perpendicular to the coupling sleeve long axis 99, as well as a second level shoulder area 118*b* perpendicular to the coupling sleeve long axis 99. The first bearing shoulder 118*a* is facing the first coupling sleeve end 55*a* and the second bearing shoulder 118*b* is facing the second coupling sleeve end 55*b*. Two cylindrical pipe segments 119 which lie opposite each other in a radial direction and are separated from each other in a circumferential direction connect to the second bearing shoulder 118*b*. The cylindrical pipe segments 119 form the second end area 102.

Figure 21:
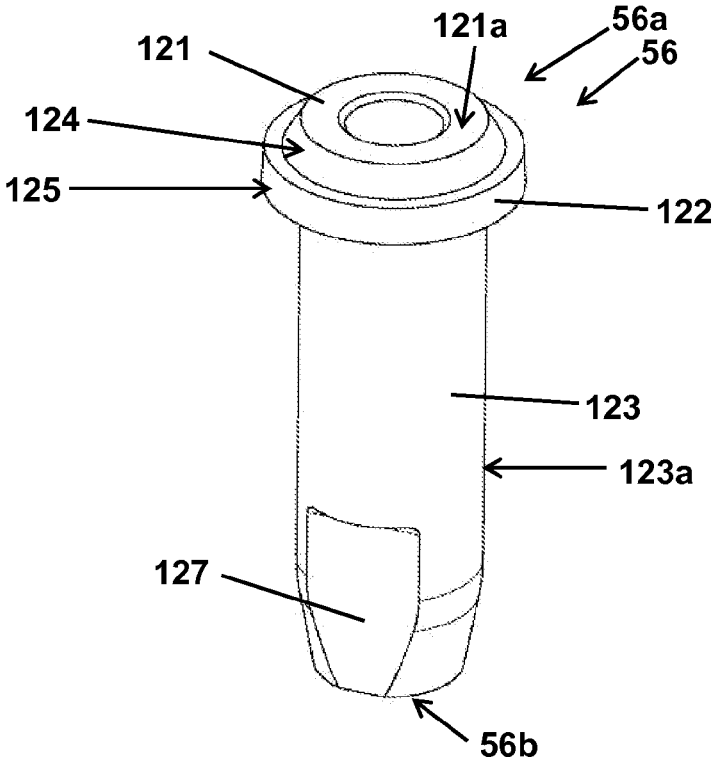
FIG. 21 is a perspective view of a coupling pin.
Figure 22:
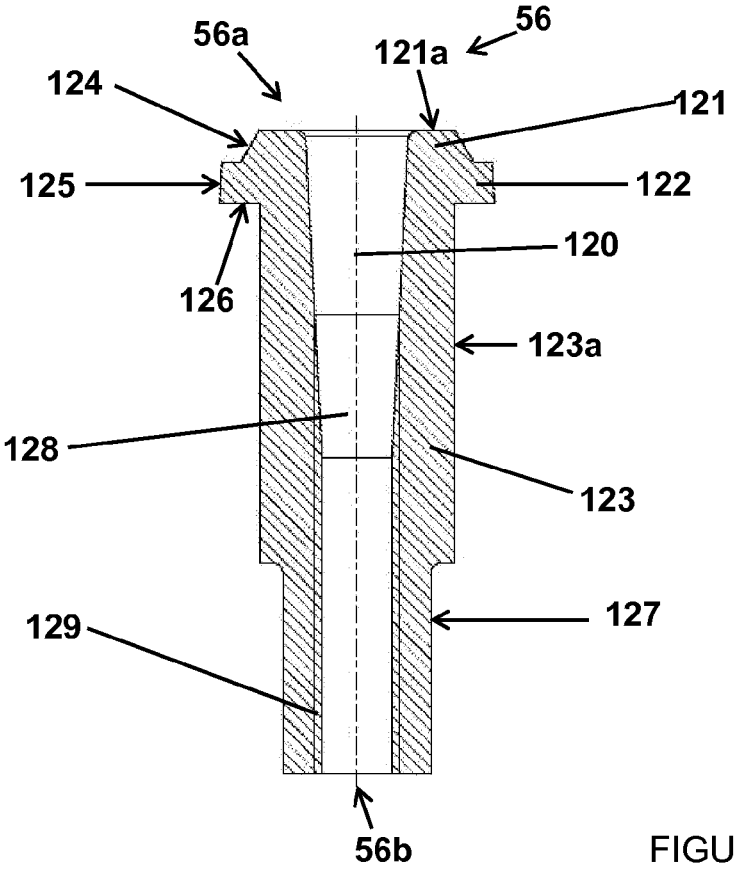
FIG. 22 is a longitudinal cut through the coupling pin.

The coupling pin 56 (FIGS. 21, 22) is provided to convey the axial movement of the coupling sleeve 55 in the direction of the cylinder axis 51 or the coupling sleeve long axis 99 to the lock mechanism. The coupling pin 56 preferably consists of metal, in particular zinc, and is produced in particular by means of die-casting. The coupling pin 56 features a longitudinal extension in the direction of a coupling pin long axis 120 which is coaxial to the cylinder axis 51 and to the coupling sleeve long axis 99. In addition the coupling pin 56 features a coupling pin head 121, a coupling pin collar 122 connecting to the coupling pin head 121, and a coupling pin shaft 123 connecting to coupling pin collar 122. Thus the coupling pin 56 features a head end or a coupling pin drive end 56*a* viewed in the direction of the coupling pin long axis 120, and a foot end 56*b* opposite the head end 56*a*. The coupling pin head 121 features a head surface 121*a* which is advantageously constructed level and perpendicular to the coupling pin long axis 120. The coupling pin head 121 also has a surrounding conical, head edge area 124.

The ring-shaped coupling pin collar 122 connects to the head edge surface 124 of the coupling pin head 121 and features a surrounding, circular cylindrical jacket-shaped collar edge area 125 and an advantageously level collar lower side 126 facing the foot end 56*b*. The collar lower side 126 is preferably perpendicular to the cylinder axis 51 or the coupling pin long axis 120.

The coupling pin shaft 123 is constructed as a circular cylinder and forms the foot end 56*b* of the coupling pin 56 on its end turned away from the coupling pin collar 122. In addition the shaft exterior area 123*a* of the coupling pin shaft 123 on the foot end 56*b* features two flat areas 127 radially opposite in relation to the coupling pin long axis 120 which assist in the mounting procedure.

The coupling pin 56 also has a recess 128 continuing from the head end 56*a* to the foot end 56*b*. As a result, the coupling pin 56 is a hollow pin. The recess 128 tapers preferably from the head end 56*a* to the foot end 56*b*. The recess 128 also has interior threading 129 on the foot end 56*b*.

Figure 23:
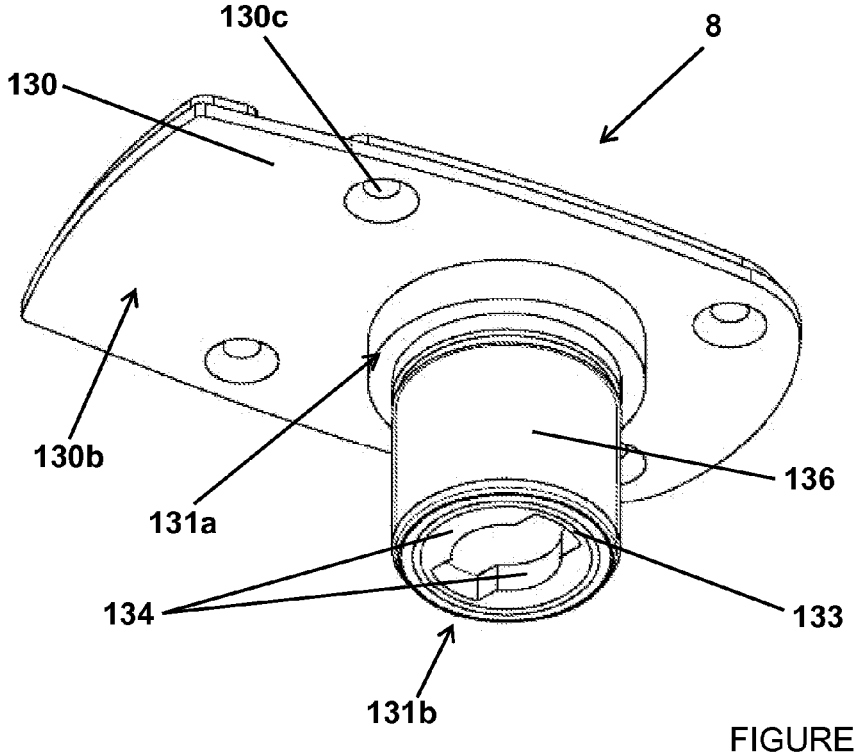
FIG. 23 is a perspective view of a cover.
Figure 24:
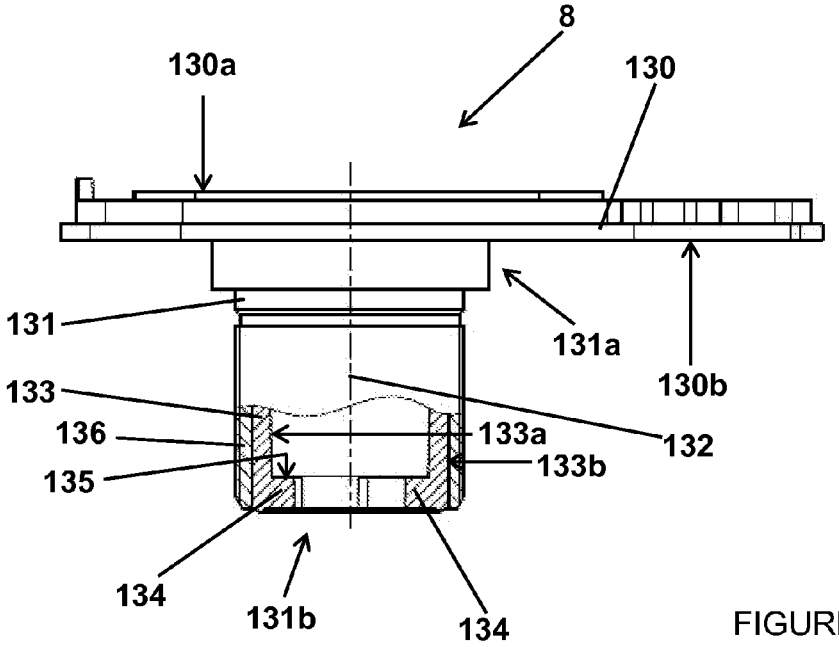
FIG. 24 is a side view of the cover, partially cut away.
Figure 25:
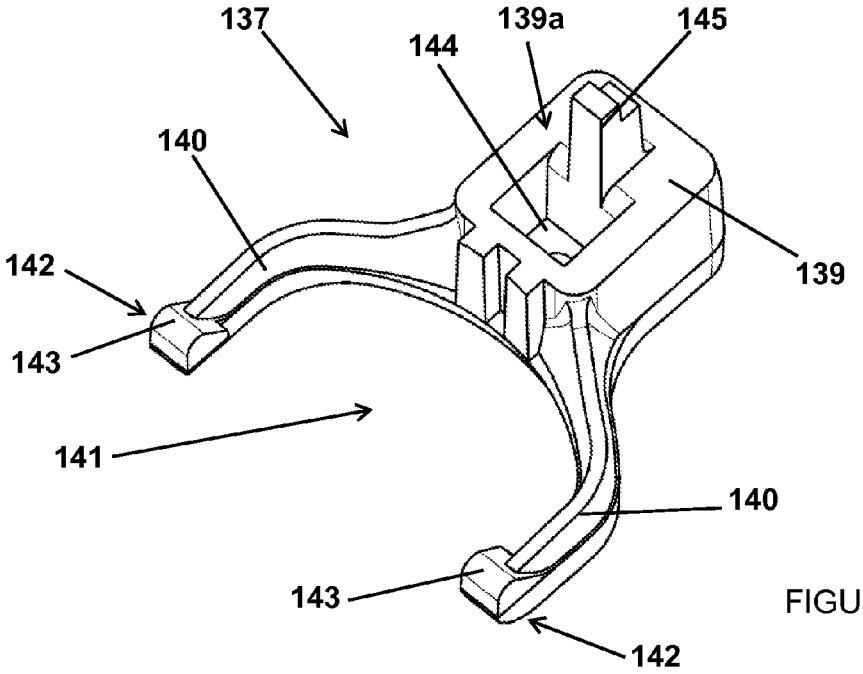
FIG. 25 is a perspective view of an activation part of a driving fork.
Figure 26:
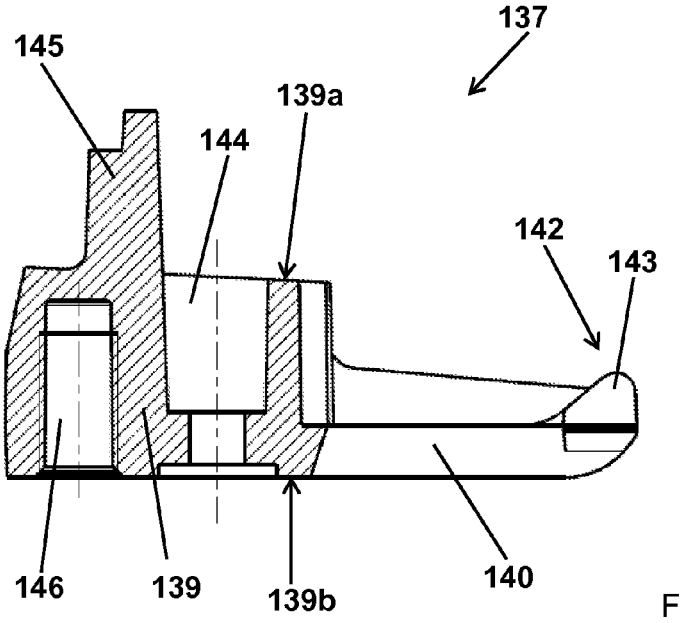
FIG. 26 is a longitudinal cross-sectional view through the activation part.
Figure 27:
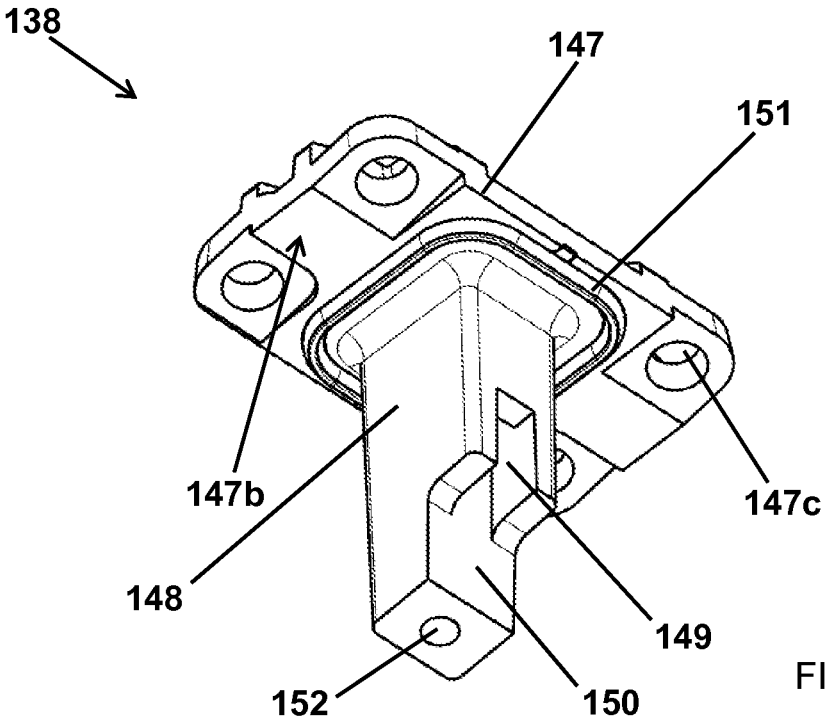
FIG. 27 is a perspective view of a coupling part of the driving fork.
Figure 28:
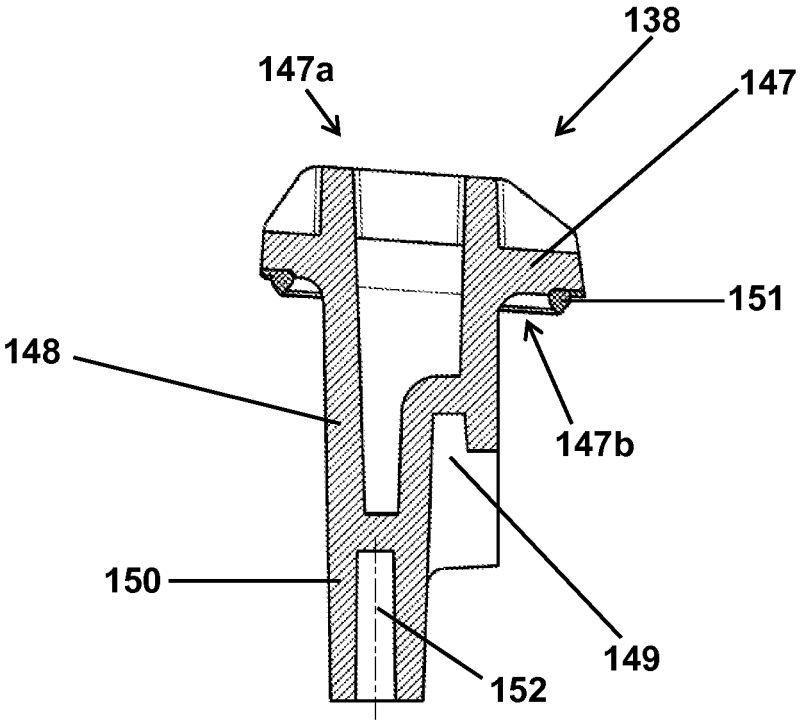
FIG. 28 is a longitudinal cross-sectional view through the coupling part.

The cover 8 (FIGS. 23, 24) of the inventive pull handle 1 features a cover plate 130 as well as a guide bushing 131 formed thereon. The cover plate 130 and the guide bushing 131 preferably consist of plastic. The cover plate 130 features a first interior, plate top side 130*a* as well as an opposite exterior, plate top side 130*b*. In addition, the cover plate 130 features screw recesses 130*c* passing through from the interior, plate top side 130*a* to the exterior, plate top side 130*b*. The guide bushing 131 connects to the exterior, plate top side 130*b* and protrudes from it. The guide bushing 131 features a guide bushing axis 132 and a guide bushing wall 133 with a wall interior area 133*a* and a wall exterior area 133*b*. The diameter of the wall interior area 133*a* of the guide bushing wall 133 corresponds to the diameter of the wall exterior area 100*b* of the coupling sleeve 56 in the guide area 105. The guide bushing 131 also features a first bushing end 131*a* facing the cover plate 130 and an opposite, second free bushing end 131*b*. The guide bushing 131 features on its free bushing end 131*b* two cylindrical pipe segments 134 radially opposite in relation to the guide bushing axis 132. The cylindrical pipe segments 134 connect to the wall interior area 133*a* of the guide bushing wall 133 and protrude from it. The cylindrical pipe segments 134 likewise have a preferably level locating surface 135 facing the first bushing end 131*a*.

The cover 8 also preferably features a threaded bushing 136 with an exterior threading which is positioned around the guide bushing 131 on the exterior and molded on it. The threaded bushing 136 consists of metal, in particular brass.

The driving fork 57 (FIGS. 25-28) is preferably constructed in two pieces and features an activation part 138 and a coupling part 139. The activation part 138 and the coupling part 139 are rigid, i.e. cannot turn or displace with respect to each other. The activation part 138 preferably consists of metal and features a preferably rectangular connection block 139 as well as two fork arms 140. The two fork arms 140 connect to the connection block 139 and protrude from it. A receiving area 141 is formed between the fork arms 140. The two fork arms 140 feature a free activation end 142. An activation flange or an activation protrusion 143 is present on the activation end 142.

The connection block 139 features a first and a second block top side 139*a*, 139*b*. The connection block 139 also has a plug opening 144 passing through the first to the second block top side 139*a*, 139*b* as well as a protruding plug element 145 protruding from the first block top side 139*a*. In addition, the connection block 139 features a threaded hole 146 with an interior threading extending from the second block top side 139*b* into the connection block 139.

The coupling part 139 preferably consists of plastic and features a fixing plate 147 and a connection shaft 148. The fixing plate 147 features a first and second plate top side 147*a*, 147*b* as well as screw recesses 147*c* passing through from the first to the second plate top side 147*a*, 147*b*. The connection shaft 148 constructed with a long extension connects to the second plate top side 147*b* and protrudes from it. In addition the fixing plate 147 features a ring-shaped seal 151 on the second plate top side 147*b*. The seal 151 is positioned around the connection shaft 148. The connection shaft 148 features on its free shaft end a plug socket 149 corresponding to the plug element 145 as well as a plug element 150 with a threaded hole 152 with an interior threading corresponding to the plug opening 144. In the assembled state the elements 144, 145, 149, 150 corresponding to each other are positively connected to each other. Furthermore the coupling part 138 and the activation part 137 are screwed to each other by means of a fixing screw 153. The fixing screw 153 is positioned inside the plug opening 144 and is screwed into the threaded hole 152. The fork arms 140 then extend diagonally to the connection shaft 148, in particular basically perpendicular.

In addition, the fixing plate 147 is secured to the handle part 3, namely connected so as to be unable to turn or displace, in particular is screwed thereto.

Figure 10:
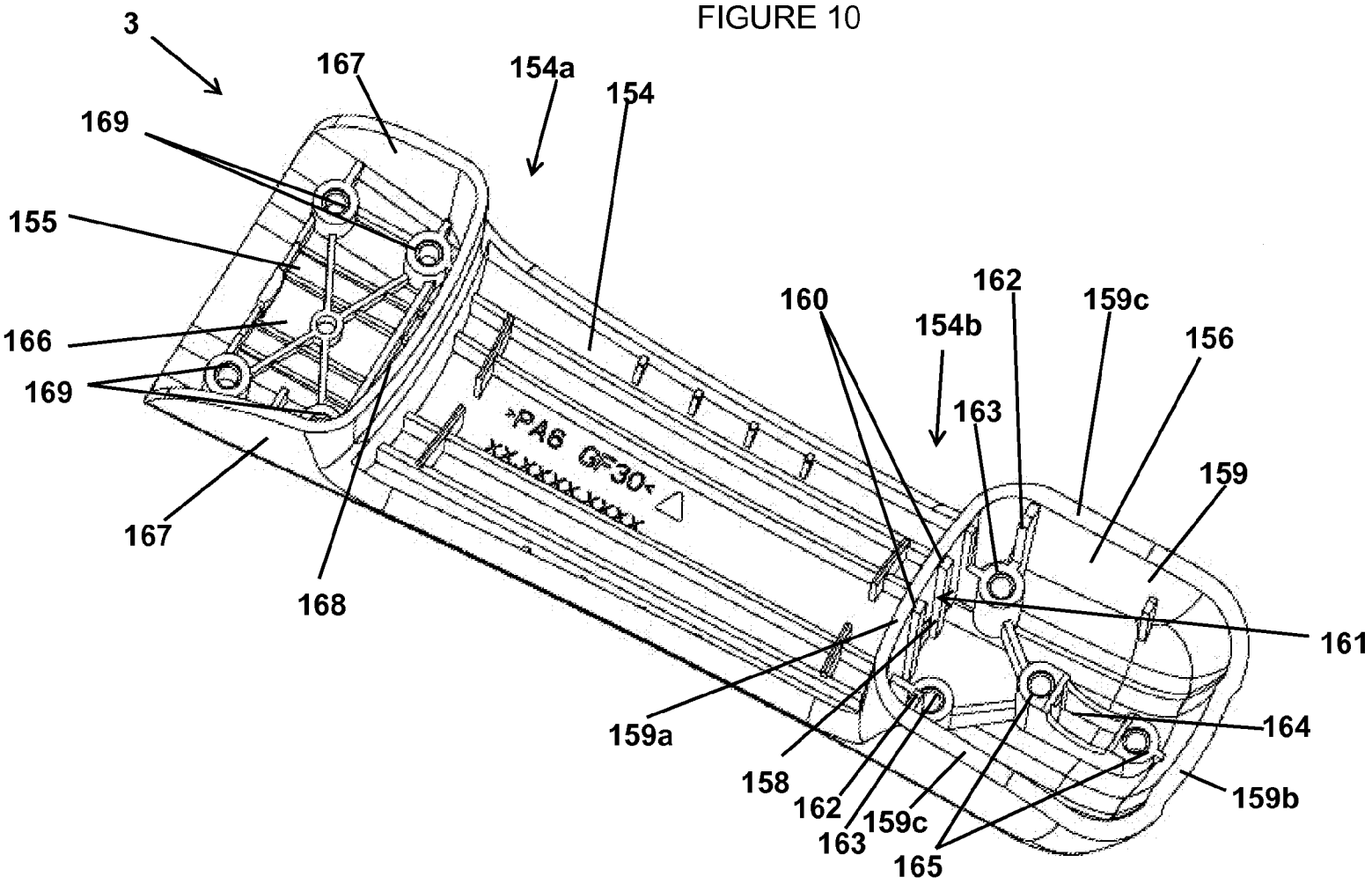
FIG. 10 is a perspective view of the handle part.

The handle part 3 (FIG. 10) preferably consists of plastic and is preferably constructed in a U-shape viewed from the side of the pull handle 1. The handle part 3 features in particular a handle area 154 constructed with a long extension with a first handle area end 154*a* facing the cylinder lock 13 and a handle area end 154*b* turned away from the cylinder lock 13. The handle part 3 also has an activation area 155 which connects to the first handle area end 154*a* and a bearing area 156 which connects to the second handle area end 154*b*.

The handle area 154 is preferably constructed as a hollow body and preferably features a removable handle area cover 157.

The bearing area 156 is preferably beaker-shaped or cup-shaped and features a base wall 158 as well as a circumferential wall 159 connecting to the base wall 158. The circumferential wall 159 features a front wall 159*a* facing the cylinder lock 13, a rear wall 159*b* opposite it, and two side walls 159*c*. The bearing area 156 is open opposite the base wall 158. The extension of the base wall 158 thereby connects to the handle area 154. The bearing area 156 also features two ribs 160 parallel to each other which form a bearing groove 161. The ribs 160 connect in the interior to the front wall 159*a* and protrude inward from it. Furthermore the ribs 160 extend from the base wall 158 to the open end of the bearing area 156. In addition, the bearing area 156 features two bearing ribs which likewise extend from the base wall 158 to the open end of the bearing area 156. Thus each respective bearing rib 162 connects on the inside to one of the two side walls 159*c* and protrudes inward from it. The bearing ribs 162 are positioned adjacent to the front wall 159*a*. Two screw domes 163 connect inside to the base wall 158 and protrude from it. Also present is a bearing shell 164 which also features two screw domes 165 with an interior threading. The bearing shell 164 with the screw domes 165 likewise connects to the base wall 158 and protrudes from it. The bearing shell 164 is positioned adjacent to the rear wall 159*b*.

The activation area 155 also features a base wall 166 as well as two side walls 167 and a rear wall 168 facing the bearing area 156. The base wall 166 connects as an extension to the handle area 154. The two side walls 167 and the back wall 168 connect to the base wall 166 and protrude from it. The rear wall 168 is positioned between the two side walls 167 and is connected with it. The two side walls 167 feature free edges 167*a* opposite the back wall 168 which exhibit an arc-shaped profile. Furthermore four screw domes 169 with interior threading are present which connect inside to the base wall 166 and protrude from it. The screw domes 169 serve to secure the fixing plate 147 which will be explained further below.

Figure 29:
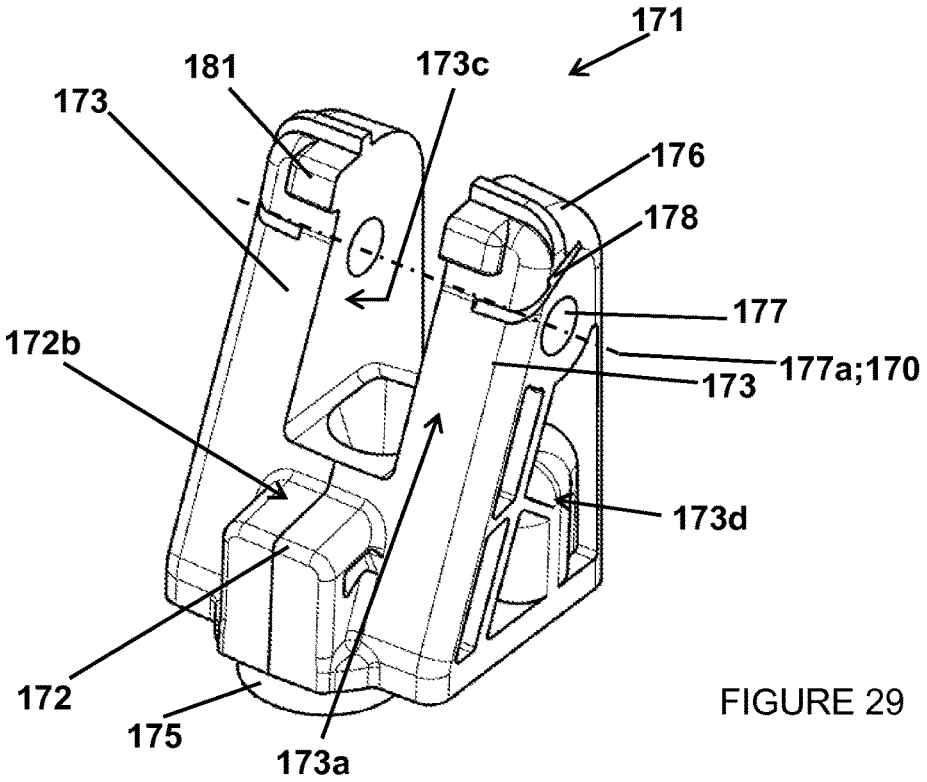
FIG. 29 is a perspective view of a supporting bracket.
Figure 30:
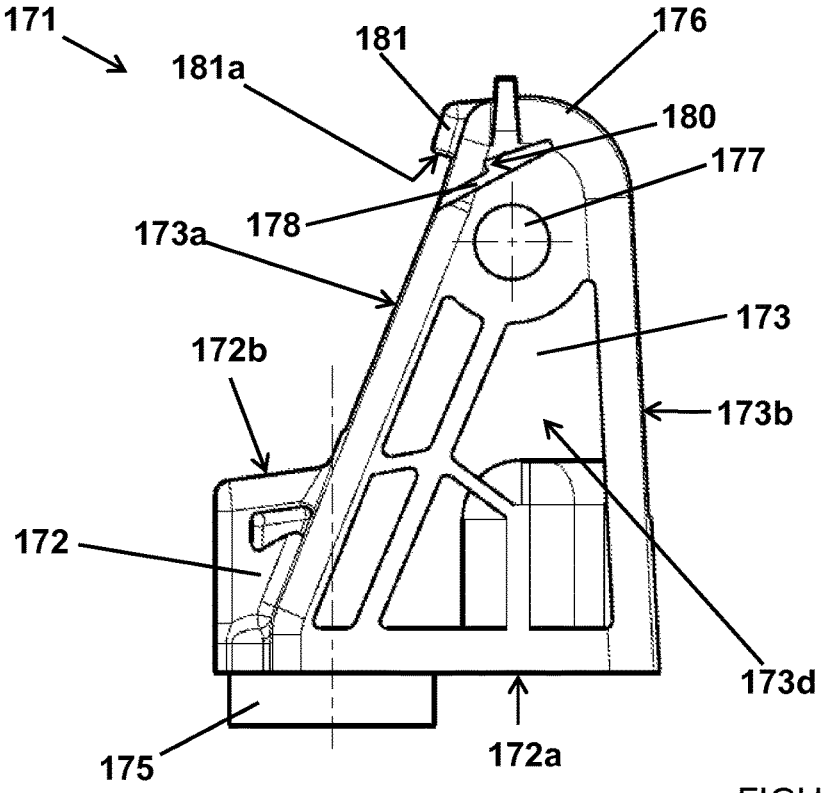
FIG. 30 is a side view of a supporting bracket.

As already mentioned, the handle part 3 is connected to the bearing part 2 so as to rotate around a rotation axis 170. To that end the pull handle 1 features a bearing mounting bracket 171 (FIGS. 29, 30) consisting preferably of plastic. The mounting block 171 features a fixing block 172 as well as bearing arms 173. The fixing block 172 features a block lower side 172*a* and a block top side 172*b*. The fixing block 172 also features a preferably metallic threaded sleeve 174 with interior threading molded in the fixing block 172. The threaded sleeve 174 is open to the block lower side 172*a* and extends from the block lower side 172*a* to the block top side 172*b*. A ring collar 175 is also present which surrounds the threaded sleeve 174 and protrudes above the block lower side 172*a*. Furthermore the fixing block 172 features a threaded hole (not shown) which extends from the block lower side 172*a* to the block top side 172*b* and is open to the block lower side 172*a*. The threaded hole is positioned adjacent to the threaded sleeve 174.

The two bearing arms 173 extend away from the block top side 172*b* and are positioned adjacent to each other. The bearing arms 173 feature an arm front side 173*a*, an arm back side 173*b* opposite thereto, as well as an arm interior side 173*c*, and an arm exterior side 173*d*. The two arm interior sides 173*c* of both bearing arms 173 are facing each other, separated from each other, and are preferably level and parallel to each other. In addition, the bearing arms 173 feature a free arm end 176 facing away from the fixing block 172. The bearing arms 173 feature on the free arm end 176 a continuous bearing recess 177 whose recess axis 177*a* is coaxial to the rotation axis 170. The two arm interior sides 173*c* are preferably perpendicular to the recess axis 177*a*. Above the bearing recess 177 the bearing arms 173 exhibit a spring accommodation slot 178 to receive a leaf spring 179 which will be further explained below. The spring accommodation slot 178 is open to the arm front side 173*a* and the arm exterior side 173*d* and closed to the arm back side 173*b* and to the arm interior side 173*c*. The spring accommodation slot 178 also features a step shoulder 180.

The two bearing arms 173 feature a support trunnion 181 protruding from the arm front side 173*a*. The support trunnions 181 are positioned above the respective spring accommodation slot 178 and feature a support edge 181*a* turned away from the free arm end 176.

Figure 31:
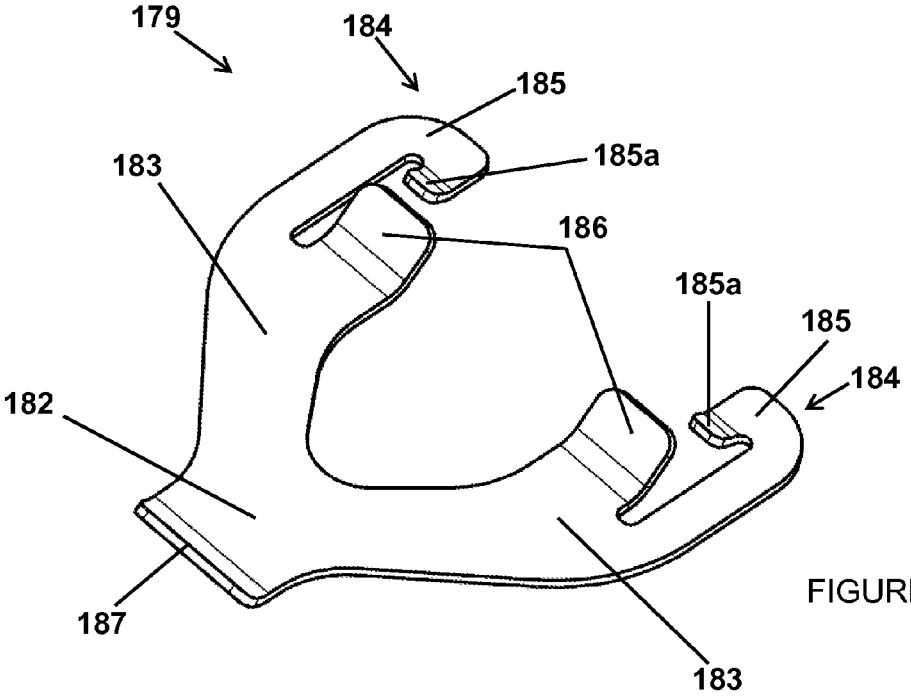
FIG. 31 is a perspective view of a leaf spring.

The leaf spring 179 (FIG. 31) features two spring arms 183 connected in a connection area 182. The spring arms 183 likewise form a fork or are arranged in a fork-like manner. The leaf spring 179 also features a first and a second spring top side 179*a*, 179*b*. The spring arms 183 feature free spring arm ends 184 turned away from the connection area 182 as well as an arm interior side 183*a* and an arm exterior side 183*b*. The two arm interior sides 183*a* face each other. The spring arms 183 feature a hook 185 on the free spring arm end 184. The hook is constructed in a U-shape and features a free hook end 185*a* which is preferably bent somewhat away from the second spring top sides 179*b*. The two hook ends 185*a* likewise face each other and are positioned on the spring interior side. The hooks 185 can also be constructed in an L-shape (not shown).

Both spring arms 183 also feature a support bracket 186 which is positioned opposite the hook 185 and likewise on the spring inside. The support bracket 186 is also preferably somewhat bent away from the second spring top side 179*b*. In addition a free end 187 of the connection area 182 opposite the spring arms 183 is preferably somewhat bent away from the second spring top side 179*b*.

Figure 32:
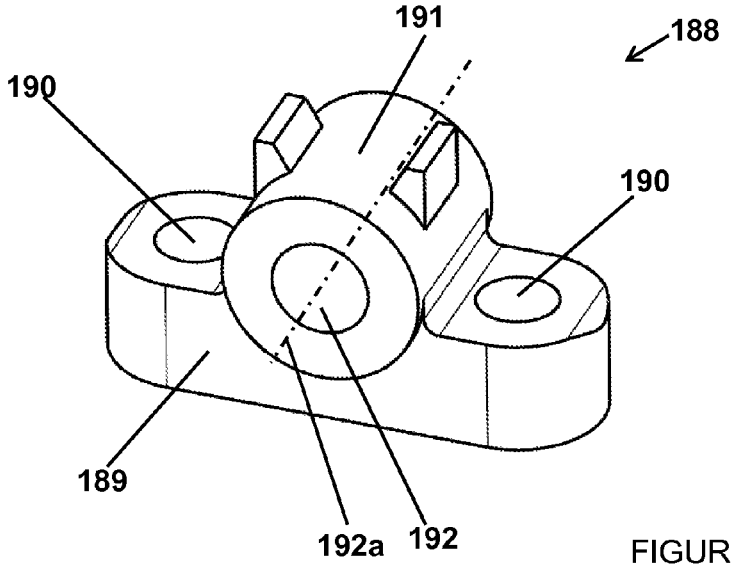
FIG. 32 is a perspective view of a bearing.

For the rotatable mounting of the handle part 3 around the rotation axis 170 the pull handle 1 features a bearing 188 (FIG. 32) preferably consisting of plastic. The bearing 188 features a long basic body 189 with two continuous recesses 190 as well as a bearing sleeve 191 with a continuous bearing recess 192. A recess axis 192*a* of the bearing recess 192 is coaxial to the rotation axis 170. The bearing recess 192 serves to accommodate an axle bolt 193 which will be explained in detail below.

Figure 33:
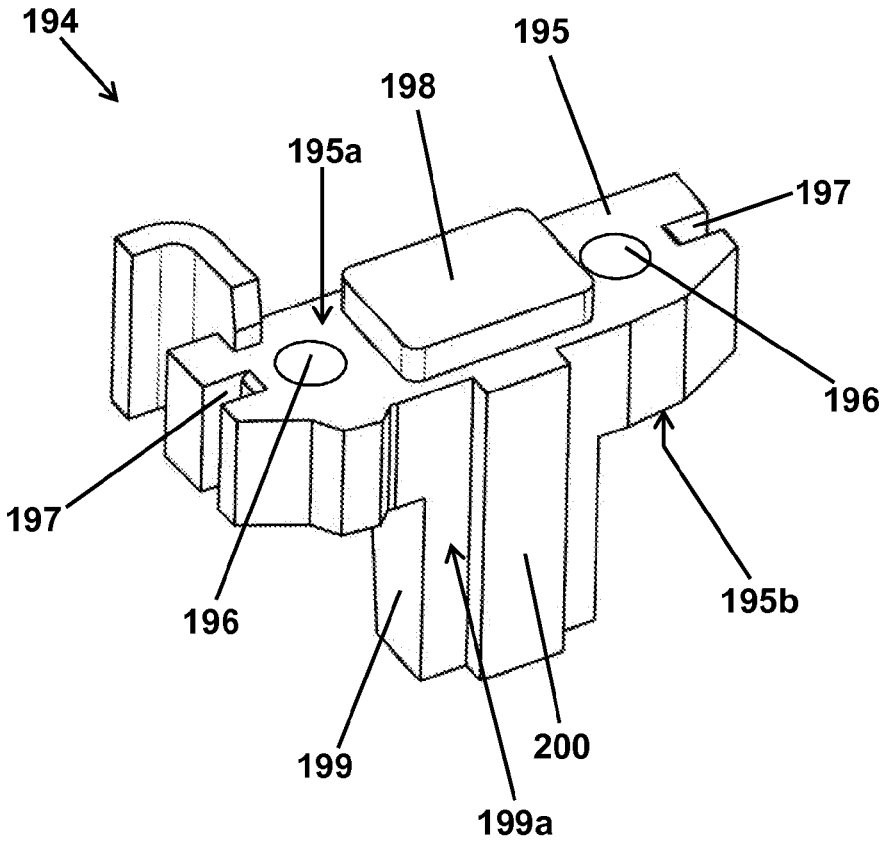
FIG. 33 is a perspective view of a spring compressor.

The pull handle 1 also features a spring compressor 194 (FIG. 33) preferably consisting of plastic. The spring compressor 194 features a long basic body 195 with a first and second body top side 195*a*, 195*b*. The basic body 195 features two continuous recesses 196 from the first to the second basic body top side 195*a*, 195*b*. Furthermore, the basic body features on both its free ends a continuous slot 197 from the first to the second basic body top side 195*a*, 195*b*. In addition the spring compressor 194 features a contact plate 198 which is positioned on the first basic body top side 195*a* and is at a distance to it.

The spring compressor also features a bar 199 which protrudes from the second basic body top side 195*b*. The bar 199 is positioned in the middle in relation to the longitudinal extension of the basic body 195. The bar 199 also features a strip 200 on a bar back side 199*a* turned away from the basic body.

In the following section the assembled pull handle 1 will be explained:

In the assembled state of the pull handle 1 (FIGS. 2 and 3) the cover 8 is secured to the bearing housing 7, thus is unable to rotate and displace, but is detachably connected, in particular screwed. The screws used (not shown) thereby engage the four screw recesses 130*c* of the cover plate 130 of the cover 8 and are screwed into the screw domes 201 with interior threading which are molded on the housing base 11 of the bearing housing 7. The cover plate 130 of the cover 8 covers or closes the bearing housing 7 at its open end. The cover plate 130 thereby connects to the second plate end 6*d* of the base plate 6 and is positioned on its extension. The interior plate top side 130*a* of the cover plate 130 faces the bearing housing 7. As a result, the guide bushing 131 of the cover 8 is positioned outside the bearing housing 7. In particular, the guide bushing 131 points away from the bearing housing 7.

As explained above, the locking cylinder 24 is mounted in the bearing housing 7, in particular in the bearing bushing 18 so as not to displace or rotate. The locking cylinder is preferably molded into the bearing bushing 18. The locking cylinder 24 thereby rests on the first circular cylindrical interior area section 23 and the conical interior area section 25 of the bushing wall inner area 22 of the bearing bushing 18. The cylindrical axis 51 is thereby coaxial to the bearing bushing axis 19.

The cylinder core 48 is, as stated above, mounted in the locking cylinder 24 so as to be axially non-displaceable but can rotate around the cylinder axis 51 after insertion of an appropriate key.

The adapter pin head 59 of the adapter pin 52 rests with its head lower side 59*b* on the second ring area 29 of the bushing wall inner area 22 of the bearing bushing 18. Consequently, the adapter pin head 59 is tensioned in an axial direction between the second ring area 29 and the cylinder core 48. The head edge area 62 of the adapter pin head 59 of the adapter pin 52 is positioned inside the third circular cylindrical, inner area section 28 of the bushing wall inner area 22 of the bearing bushing 18. The adapter pin collar 60 of the adapter pin 52 is positively positioned inside the fourth circular cylindrical inner area section 30 of bushing wall inner area 22 of the bearing housing 18 and inside the pass-through opening 31 of the bearing bushing 18. The adapter pin 52 thus cannot displace in the axial direction but can rotate in the bearing bushing 18 around the adapter pin long axis 58 and the cylinder axis 51. The drive pin 64 of the cylinder core 48 also positively engages in the drive slot 63 of the adapter pin 52. Consequently, the adapter pin 52 with the cylinder core 48 cannot rotate around the cylinder axis 51 when connected. Or the adapter pin 52 is connected to the cylinder core 48 so as to be movable in rotation around the cylinder axis 51.

Furthermore, the adapter pin 52 engages through the pass-through opening 31 of the bearing bushing 18. The driving ribs 67 and the adapter pin shaft 61 of the adapter pin 52 are thus positioned outside the bearing bushing 18. The adapter pin head 59 and the adapter pin collar 60 are positioned inside the bearing bushing 18.

The follower sleeve 53 is connected with the adapter pin 52 so as not to rotate around the cylinder axis 51. Or the follower sleeve 53 is connected with the adapter pin 52 so as to be movable in rotation around the cylinder axis 51. Or the follower sleeve 53 is connected via the adapter pin 52 with the cylinder core 48 so as to be movable in rotation around the cylinder axis 51. The adapter pin 52 thus serves to convey the rotation movement of the cylinder core 48 without delay or free-wheel to the follower sleeve 53. To that end the adapter pin shaft 61 of the adapter pin 52 is positioned in the area of the drive ribs 67 inside the sleeve recess 74 of the follower sleeve 53. The shaft wall interior area 75*a* of the shaft wall 75 of the follower sleeve 53 surrounds the adapter pin shaft 61 and the drive ribs 67 in a positive lock. The residual part of the adapter pin shaft 61 protrudes out of the follower sleeve 53. The panel top side 72*a* of the head panel 72 of the follower sleeve 53 also rests on the contact area 35 of the bushing wall base area 32 of the bearing bushing 18.

The follower sleeve 53 also is connected to the torsion spring 41. The torsion spring 41 is pre-tensioned in the initial position or 0-position of the follower sleeve 53. The initial position corresponds to the position of the follower sleeve 53 at the initial position or 0-position of the cylinder core 48. To that end the torsion spring 41 is positioned around the shaft wall outer area 75*b* of the shaft wall 75 of the follower sleeve 53 and is supported on one end on the spring pin 82 of the follower sleeve 53 and on the other end on the spring pin 40 of the bearing bushing 18. If the follower sleeve 53 rotates around the cylinder axis 51, regardless of the direction, the torsion spring 41 is further tensioned and drives the follower sleeve 53 back into its initial position against the deflection direction. That means the torsion spring 41 has to rotate the follower sleeve 53 against the respective deflection direction. Consequently, the torsion spring 41 drives the follower sleeve 53, after deflection, against the respective deflection direction relative to the bearing housing 7.

The locating sleeve 54 with the locating sleeve wall 83 is positioned around the sleeve shaft 73 of the follower sleeve 53. In this respect the two guide areas 79 of the follower sleeve 53 rest on the wall interior area 85 of the locating sleeve wall 83. And the first guide areas 78 of the follower sleeve 53 rest on the rib interior areas 95 of the drive ribs 94 of the locating sleeve 54. The shaft end area 81 of the sleeve shaft 73 of the follower sleeve 53 also rests on the first rib collar surface 88*a* of the ring collar 88 of the locating sleeve 54. And the adapter pin 52 penetrates the locating sleeve wall 83 and protrudes above the second wall end area 83*b* and extends out of the locating sleeve 54.

The first activation areas 80*a* of the follower sleeve 53 also rest on the first rib edges 96*a* of the drive ribs 94 of the locating sleeve 54. Consequently, the locating sleeve 54 is connected to the follower sleeve 53 so as to be movable in rotation around the cylinder axis 51 in the locking direction 202. A turning movement of the follower sleeve 53 in the locking direction 202 is conveyed directly and immediately, namely without any delay or play, to the locating sleeve 54.

In addition the detents 92 of the latching arms 90 of the locating sleeve 54 are positioned in a locking depression 37 into which it engages. That is effected by a second torsion spring 97. The second torsion spring 97 is positioned around the adapter pin shaft 61 and is supported at one end on the second ring collar surface 88*b* turned away from the follower sleeve 53, and on the other end on a supporting disc 203. The supporting disc 203 is adjacent to the foot end 52*b* of the adapter pin 52 and is positioned around the adapter pin shaft 61 and axially connected to it so as not to be displaced. The second torsion spring 97 presses the locating sleeve 54 in the direction of the bearing bushing 18. The locating sleeve 54 thus is connected to the second torsion spring 97 so as to be driven in an activation direction 204 parallel to the cylinder axis 51. As a result, the detents 92 of the locating sleeve 54 are pressed into the locking depressions 37. And thus the locating sleeve 54 can only be rotated around the cylinder axis 51 against the force of the second torsion spring 97.

In the non-activated state (FIG. 2), namely when the handle part 3 is not activated, the locating sleeve 54 is also positioned in the bearing section 103 of the coupling sleeve 55. The two latching arms 90 of the locating sleeve 54 are thereby positioned between two ribs 112 of the coupling sleeve 55. The slide surfaces 91 of the latching arms 90 rest on the ribs 112. The locating sleeve 54 thereby is positioned in the area of the first rib ends 112*a* of the ribs 112. The coupling sleeve 55 thus is connected to the locating sleeve 54 so as not to rotate around the cylinder axis 51. Or the coupling sleeve 55 is connected to the locating sleeve 54 so as to be movable in rotation around the cylinder axis 51. In any event the coupling sleeve 55 can displace in an axial direction, namely parallel to the cylinder axis 51, by a limited amount relative to the locating sleeve 54.

The coupling sleeve 55 can displace in a direction parallel to the cylinder axis 51 and is mounted in a bearing part 2, in particular the bearing housing 7, so as to rotate around the cylinder axis 51. To that end the bearing section 103 of the coupling sleeve 55 is guided in the bearing sleeve 42 of the bearing housing 7. In particular the wall outer area 100*b* of the coupling sleeve wall 100 rests on the guide ribs 47 in the area of the bearing section 103. In addition the guide section 105 of the coupling sleeve 55 is positioned inside the guide bushing 131 of the cover 8. The wall outer area 100*b* of the coupling sleeve wall 100 rests on the wall interior area 133*a* of the guide sleeve wall 133 in the area of the guide section 105. The coupling sleeve 55 is thus displaceable in the cover 8 in a direction parallel to the cylinder axis 51 and is mounted so as to rotate around the cylinder axis 51. In the non-activated initial position the second end area 102 of the coupling sleeve wall 100 thereby rests on both locating surfaces 135 of the guide bushing 131 of the cover 8. The coupling sleeve 55 thus does not protrude out of the cover 8.

In this non-activated position the coupling sleeve 55 is compressed by the first torsion spring 114. The first torsion spring 114 is positioned around the bearing bushing 18 and rests in particular on the bushing wall outer area 21. The first torsion spring 114 is thus positioned in the ring gap 45. On one end the torsion spring 114 is thereby supported on the locating surface 46 of the housing base 11. The first torsion spring 114 is supported on the other end on the ribs 112, in particular on the first rib end 112*a*. For that reason the first torsion spring 114 is positioned in the receiving trough 113 of the ribs 112. As a result, the first torsion spring 114 presses the coupling sleeve 55 away from the housing base 11 on which the cover 8 is located in its non-activated position. The coupling sleeve 55 thus is connected with the first torsion spring 114 and able to be driven against the activation direction 204.

The coupling pin 56 is mounted in the coupling sleeve 55 so as not to displace in an axial direction parallel to the coupling pin long axis 120 but is freely able to rotate around the coupling pin long axis 120. In particular the coupling pin 56 with the coupling pin head 121 and the coupling pin collar 122 is positioned inside the guide section 105 of the coupling sleeve 55. To that end the coupling pin 56 with the collar lower side 126 rests on the first shoulder area 118*a* of the bearing shoulder 117 of the coupling sleeve 55. A clamp ring 205 is also present which secures the coupling pin 56 in the axial direction. The coupling pin shaft 123 thereby protrudes out of the coupling sleeve 55 at the second coupling sleeve end 55*b*. Furthermore, in the non-activated state of the handle part 3 (FIG. 2), the coupling pin 56 also protrudes from the guide bushing 131 at the second bushing end 131*b*, namely from the pull handle housing 1*a*. As a result, the coupling pin 56 can be connected to the activation mechanism of a lock. Thus the coupling pin 56 serves to connect to the coupling elements of the lock mechanism which are positioned outside the pull handle housing 1*a*.

As already stated above, the driving fork 57 is constructed in two parts. In the assembled state the activation part 138 and the coupling part 139 are rigidly joined together. The driving fork 57 is also rigidly connected to the handle part 3. For that reason four securing screws 76 are present which engage in the screw recesses 147*c* and are screwed into the screw domes 169. The connecting shaft 148 then protrudes from the base wall 166 of the activation area 155 of the handle part 3. The connection shaft 148 penetrates the second housing opening 16. In the process the seal 151 rests on the exterior shoulder area 15 of the stepped shoulder 14 of the bearing housing 7.

The two fork arms 140 of the driving fork 57 positioned inside the bearing housing 7 and outside the coupling sleeve 55, in particular the bearing area 103, encompass the coupling sleeve 55. The coupling sleeve 55 is also positioned in the receiving area 141. The activation protrusions 143 of the fork arms 140 then rest on the coupling areas 107 of one of the coupling pins 106 of the coupling sleeve 55. As a result the coupling sleeve 55 is connected to the handle part 3 and able to be moved by the driving fork 57 into the activation direction 204.

Figure 34:
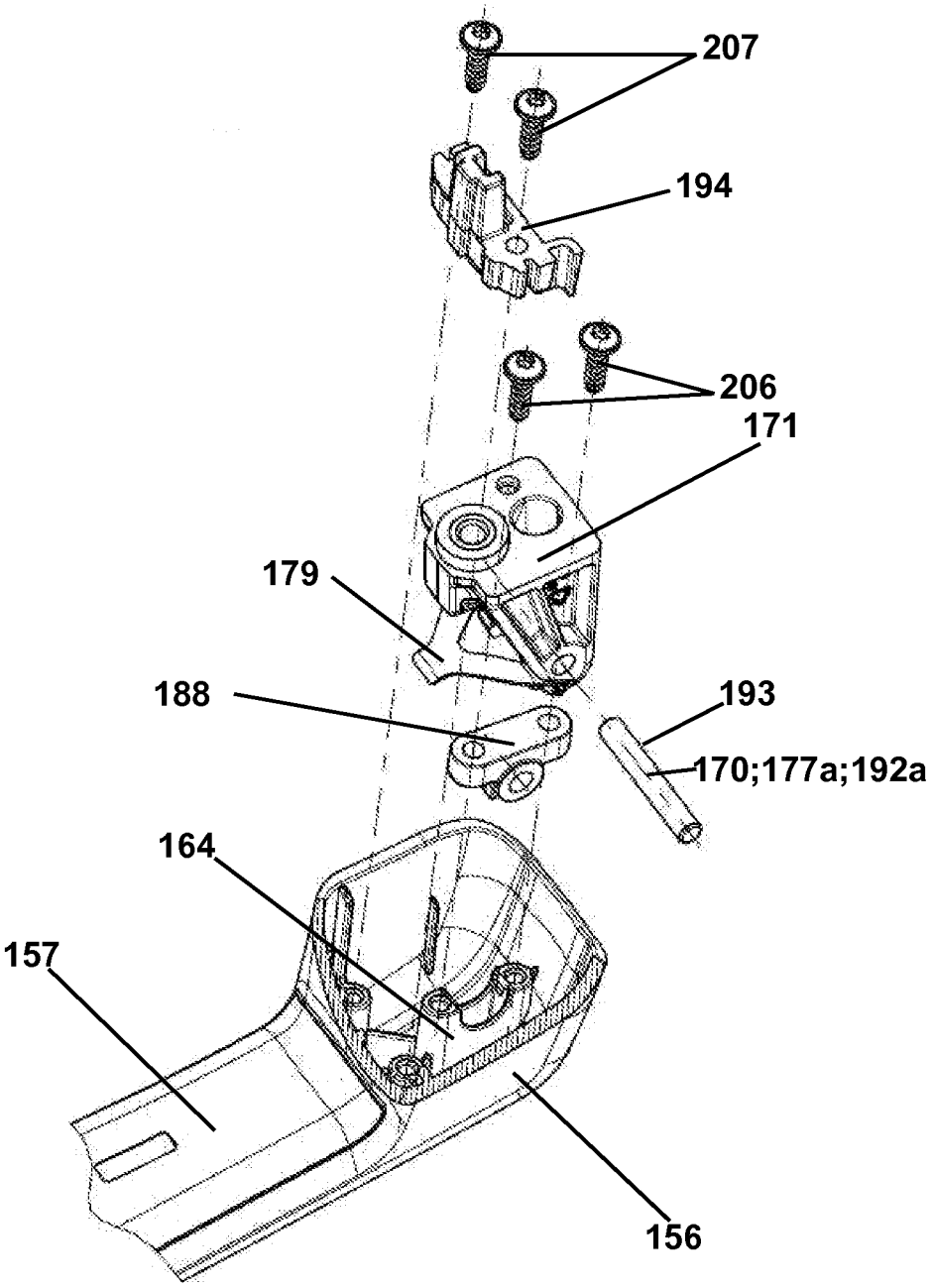
FIG. 34 is an exploded depiction in perspective of the mounting means of the inventive pull handle.

As previously stated, the handle part 3 can rotate around the rotation axis 140 with the bearing part 2, in particular connected to the base plate 6 (FIGS. 2, 3 and 34). For that purpose the bearing 188 is firmly connected to the base wall 158 of the bearing area 156 of the handle part 3, in particular by screwing. Securing screws 206 penetrate the recesses 190 of the bearing 188 and are screwed into the screw domes 165 of the bearing shell 164. The axle bolt 193 is positioned in the bearing recess 192 of the bearing 188. The axle bolt 193 is also positioned in both bearing recesses 177 of the bearing arms 173 of the mounting bracket 171. The bearing 188 is thereby positioned between the two bearing arms 173. The mounting bracket 171 is furthermore firmly connected to the base plate 6. For that reason a securing screw (not shown) is present which penetrates a recess in the base plate 6 and is screwed into an interior threading of the fixing block 172. The bearing arms 173 thus are spaced away from the base plate 6.

The axle bolt 193 is thus positioned completely inside the handle part 3, in particular the bearing area 156 of the handle part 3.

The threaded sleeve 174 of the mounting bracket 171 thereby penetrates a recess in the base plate 6 so that it is accessible from the second base plate top side 6*b* or is open to the second base plate top side 6*b*. Thus the mounting bracket 171 can be secured by means of another securing screw (not shown) to a vehicle door of metal, glass or plastic. The securing screw thereby penetrates into an opening in the vehicle door. A rubber underlay is positioned on the door interior in a known manner between the vehicle door and the pull handle 1 as a seal and a lining sheet, both of which are likewise penetrated by the securing screw. The lining sheet serves to distribute force. The door lock is also normally secured to the lining sheet.

Thus at least a part of the forces is conveyed to the leaf spring 179 on the vehicle door. The base plate 6 is thus relieved of pressure. In addition, the forces applied upon pulling of the handle part 3 are guided at least in part directly—that is, not via the base plate 6—to the vehicle door via the other securing screw.

Furthermore the leaf spring 179 is supported by the end of the connection area 187 on the spring compressor 194, in particular the first basic body top side 195*a*. For that reason, the spring compressor 194 is positioned with the strip 200 in the bearing groove 161 of the bearing area 156 of the handle part 3. In addition the ribs 160 of the bearing area 156 are positioned in the slots 197 of the spring compressor 197. The first basic body top side 195*a* points to the base wall 158 of the bearing area 156. Securing screws 207 penetrate the recesses 196 of the spring compressor 194 and are screwed into the screw domes 163. The spring compressor 194 is thus firmly connected to the bearing areas 156, namely unable to displace or twist.

Furthermore, the leaf spring 179 is supported in the area of both spring arm ends 184 on both bearing arms 143. In particular the spring arm ends 184 are respectively positioned in one of the two spring accommodation slots 178. The support bracket 186 of the leaf spring 179 rests on the support edges 181*a*. As a result the handle part 3 is connected to the leaf spring 179 so as to be able to move in rotation around the rotation axis 170 against the handle activation direction 208. The leaf spring 179 pushes the handle part 3 into its non-activated position.

If the pull handle 1 is secured on the vehicle door or lift-gate, the guide bushing 131 with the threaded bushing 136 positioned thereon penetrates an opening in the vehicle door. A nut is also screwed on the threaded bushing 136, so that the pull handle 1 is secured in a clamped manner on the vehicle door. Present between the nut and the vehicle door are, as stated above, a seal and a lining sheet which are also penetrated by the threaded bushing 136. This type of securing is especially well suited for a glass door. The reason is that only one large opening is needed in the glass plate, not several. Openings in glass plates are not easy to produce, so a single large opening is very advantageous.

Operation of the inventive pull handle will be explained in greater detail below:

In order to activate the lock mechanism of the respective lock, an operator pulls on the handle part 3 so that it is rotated around the rotation axis 170 in the handle activation direction 208 (FIG. 2) against the force of the leaf spring 179 relative to the bearing part 2 from its non-activated (FIG. 2) to its activated position (FIG. 3). As a result the driving fork 57 is also rotated in the handle activation direction 208. Thus the activation protrusions 143 of the fork arms 140 move to the base wall 11 of the bearing housing 7. The activation protrusions 143 also move proportionally in the activation direction 204. Since the activation protrusions 143 rest on the coupling areas 107 of the coupling pins 106, the coupling sleeve 55 is moved along by the activation protrusions 143 in the activation direction 204. The activation protrusions 143 thereby slide along on the coupling surfaces 107 of the coupling pins 106. The turning movement of the driving fork 57 thus causes a linear movement of the coupling sleeve 55 in an activation direction 204 parallel to the cylinder axis 51 against the force of the first torsion spring 114. The cylinder axis 51 thus represents an activation axis 209 of the activating mechanism 4 and is coaxial to it. The bearing area 103 of the coupling sleeve 55 is thereby guided into the bearing sleeve 42. The coupling sleeve 55 can thus be displaced in the activation direction 204 relative to the bearing housing 7 until the first end area 101 of the coupling sleeve 55 stops on the locating face 46 of the housing base 11.

During the movement of the coupling sleeve 55 the latching arms 90 of the locating sleeve 54 slide into the guide slots 108 of the coupling sleeve 55. In the activated state of the handle part 3 the latching arms 55 are positioned in the guide section 105 of the coupling sleeve 55. The locating surfaces 98 of the latching arms 90 preferably rest on the second slot end edges 110*b*.

Since the coupling pin 56 is connected to the coupling sleeve 55 so as not to displace, it is moved along by the coupling sleeve 55 and displaced in the activation direction 204. The linear movement of the coupling pin 56 then leads to an activation of the respective lock mechanism.

Due to the force of the leaf spring 179, when the handle part 3 is released, it rotates in the direction opposite the handle activation direction 208 back into its non-activated position (FIG. 2). The coupling sleeve 55 also moves powered by the force of the first torsion spring 114 opposite the activation direction 204 back into its non-activated position.

The above described mode of operation applies to a blocked or unblocked pull handle 1, when the lock mechanism, especially the cylinder lock 13, is in its non-blocked or unlocked position or initial position. If the pull handle 1 is now blocked, the operator inserts an appropriate key into the cylinder core 48 so that the disc tumblers 49 are retracted. Finally the lock is turned in the locking direction 202 (FIG. 4) around the cylinder axis 51 which causes a rotation of the cylinder core 48 in the locking direction 202. A rotation of the cylinder core 48 causes a rotation of the adapter pin 52 around the cylinder axis 51 in the locking direction 202. The adapter pin 52 again drives the follower sleeve 53 without any delay in the locking direction 202. Since the first activation areas 80*a* of the follower sleeve 53 rest on the first rib edges 96*a* of the driving ribs 94 of the locating sleeve 54, the locating sleeve 54 is also driven without any delay by the follower sleeve 53 in the locking direction 202. During this process the detents 92 of the coupling sleeve 55 are pressed against the force of the second torsion spring 97 out of the locking depressions 37 and after a rotation engage in the locking depressions 37 adjacent thereto.

The cylinder core 48, the adapter pin 52, the follower sleeve 53 and the locating sleeve 54 are then in their locked position.

Figure 5:
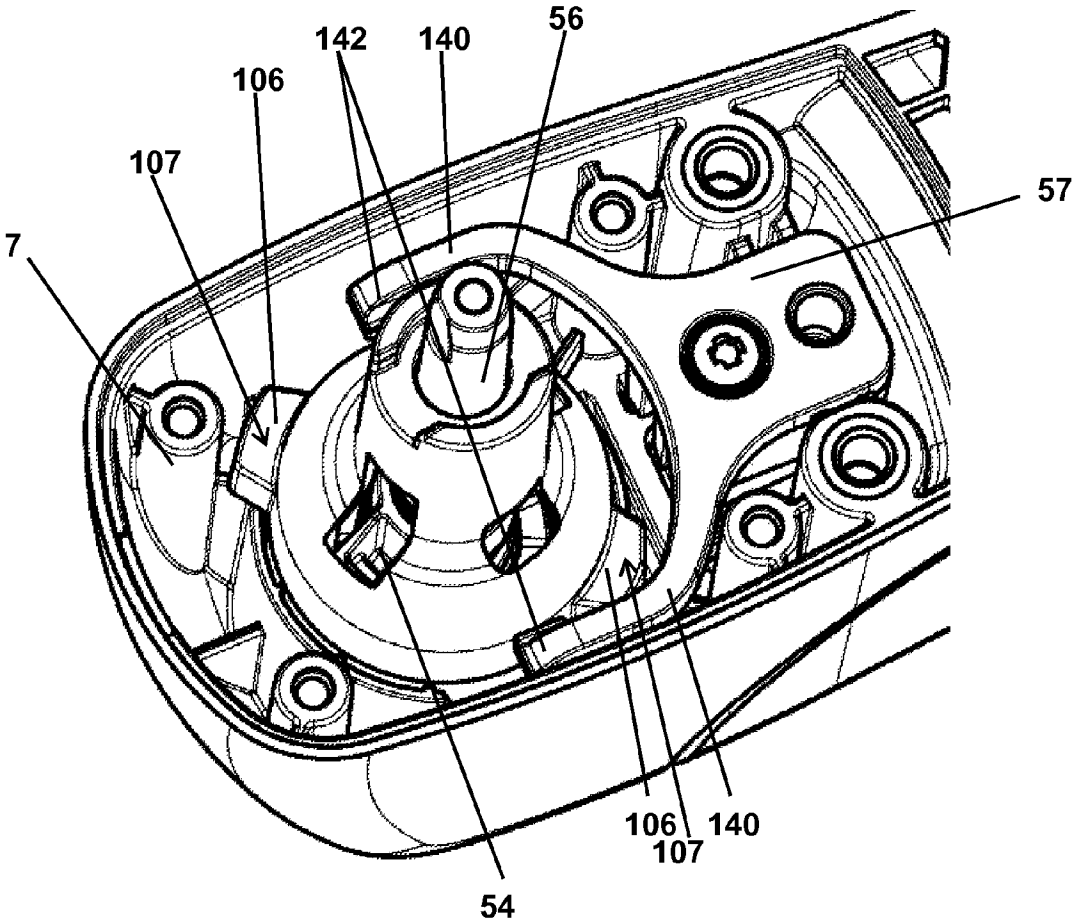
FIG. 5 is an overhead view of a part of the activation mechanism in the uncoupled or locked and activated position.
Figure 6:
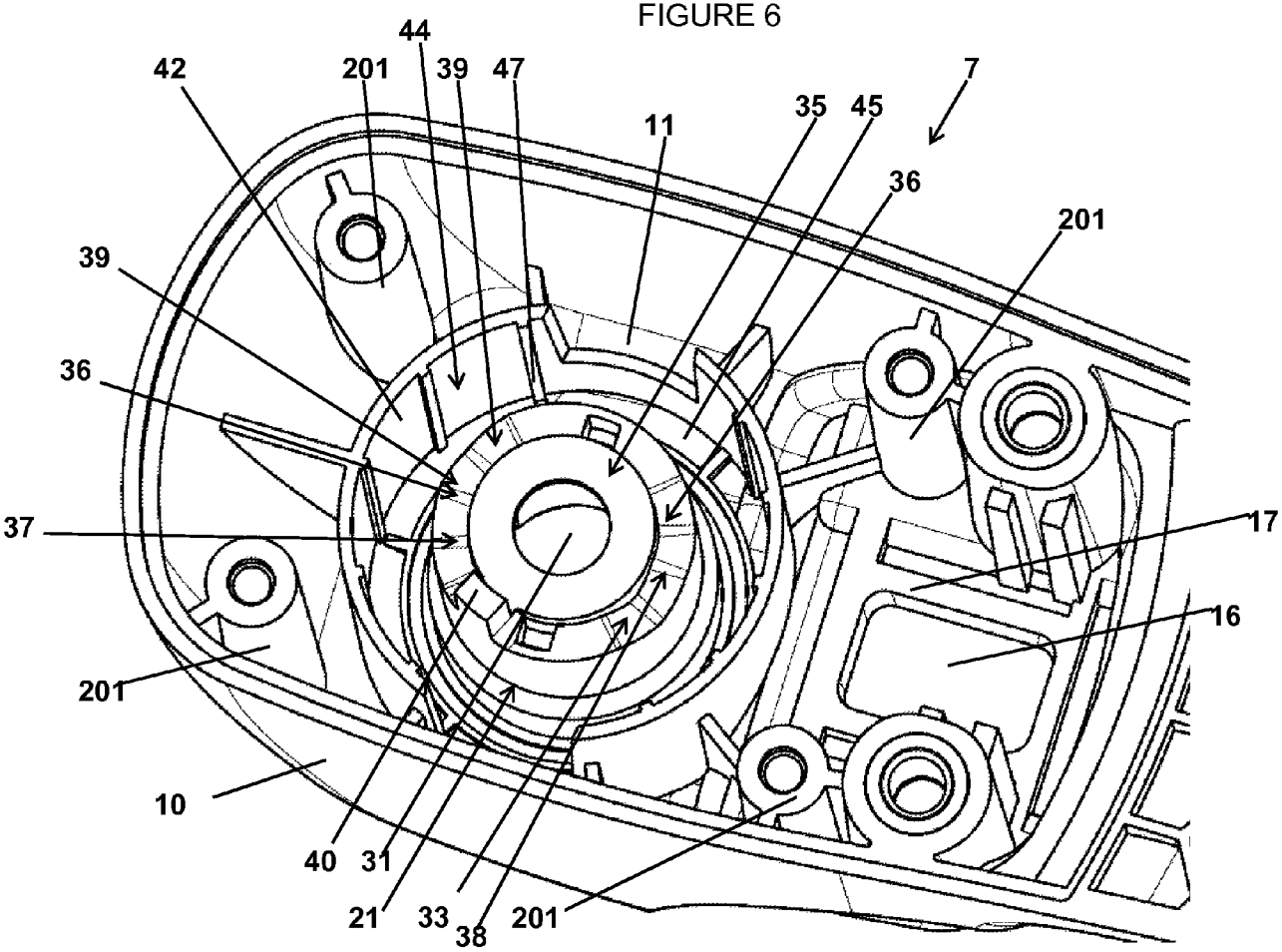
FIG. 6 is a view of the bearing housing of a bearing part from the open side.

The locating sleeve 55 [sic] again drives the coupling sleeve 55 without delay in the locking direction 202. In the process the coupling pins 106 are rotated so that they no longer are positioned aligned in the direction of the cylinder axis 51 to the activation protrusions 143 of the fork arms 140 (FIG. 5). Consequently, the driving fork 57 and the coupling sleeve 55 are mechanically decoupled from each other. The coupling sleeve 55 is located in its decoupled position. A rotation movement of the driving fork 57 in the handle activation direction 208 no longer causes a movement of the coupling sleeve 55. A no-load stroke of the handle part 3 occurs. The lock mechanics are not activated.

When the key is released, the follower sleeve 53 turns back opposite the locking direction 202 into its original position powered by the force of the torsion spring 41. The follower spring 53 also drives the adapter pin 52 and in addition the cylinder core 48 opposite the locking direction 202. They also return to their original position.

However, the locating sleeve 54 is not moved along in the locking direction 202 by the follower sleeve 53 because of the above-described free-wheel between the locating sleeve 54 and the follower sleeve 53. In particular the follower sleeve 53 can be twisted relative to the locating sleeve 54 so far opposite the locking direction 202 until the second activation areas 80*b* of the follower sleeve 53 rest on the second rib edges 96*b* of the driving ribs 94 of the locating sleeve 54.

The locating sleeve 54 and the coupling sleeve 55 thus remain in their locked position or decoupled position. If the key is again introduced and turned in the locking direction 202, the cylinder core 48, the adapter pin 52 and the follower sleeve 53 are turned in the locking direction 202, but the locating sleeve 54 and the coupling sleeve 55 are not moved again. The follower sleeve 53 only rotates relative to the locating sleeve 54 until the first activation areas 80*a* of the follower sleeve 53 again rest on the first rib edges 96*a* of the driving ribs 94 of the locating sleeve 54.

If now there is again to be an unblocking or an unbarring or a coupling, the key is turned by the operator opposite the direction of locking 202. As a result the cylinder core 48, the adapter pin 52 and the follower sleeve 53 are turned opposite the locking direction 202. Since the second activation areas 80*b* of the follower sleeve 53 rest on the second rib edges 96*b* of the driving ribs 94 of the locating sleeve 54, the locating sleeve 54 is again driven without delay by the follower sleeve 53 opposite the locking direction 202. In the process the detents 92 of the locating sleeve 54 are again pushed out of the locking recesses 37 against the force of the second torsion spring 97 and engage after rotation into the locking recesses 37 adjacent thereto. The coupling sleeve 55 is moved along by the locating sleeve 54 and rotated into its coupled position. After the key is released, the follower sleeve 53 rotates in the locking direction 202, driven by the force of the torsion spring 41 back into its initial position. The follower sleeve 53 also drives the adapter pin 52 and in addition the cylinder core 48 in the locking direction 202. Now all parts are again in their original position.

If the key is again inserted and turned unintentionally against the locking direction 202, the cylinder core 48, the adapter pin 52 and the follower sleeve 53 are indeed turned against the locking direction, but the locating sleeve 54 and the coupling sleeve 55, however, are not moved again because of the free-wheel. The follower sleeve 53 only rotates relative to the locating sleeve 54 until the second activation areas 80*b* of the follower sleeve 53 rests on the second rib edges 96*b* of the driving ribs 94 of the locating sleeve 54.

Because of the free-wheel the lock mechanism 5 thus features an impulse circuit. An impulse circuit means that the key is turned to bar and unbar the cylinder lock 13, but after release returns independently into its original position, especially by means of the spring force, wherein the barring or unbarring of the activation mechanism 4 however remains retained. That means, the functional capability or the functional status does not change, regardless of whether the activation mechanism 4 is functional or not functional.

The advantage of the inventive pull handle is that the coupling pin which serves to unlock the lock for coupling with coupling elements located outside the pull handle housing, executes a linear movement and can freely rotate around the activation axis. As a result a connection to other coupling elements is definitely simpler and the wear at the coupling location is definitely less. It is naturally understood in the context of the invention that an element with a different shape can be used as the coupling element instead of the pin.

As a result of the axle bolt being positioned completely inside the handle part, especially the bearing area of the handle part, the axle bolt and its bearing are protected. This then assures a permanent easy activation of the handle part.

Figure 35:
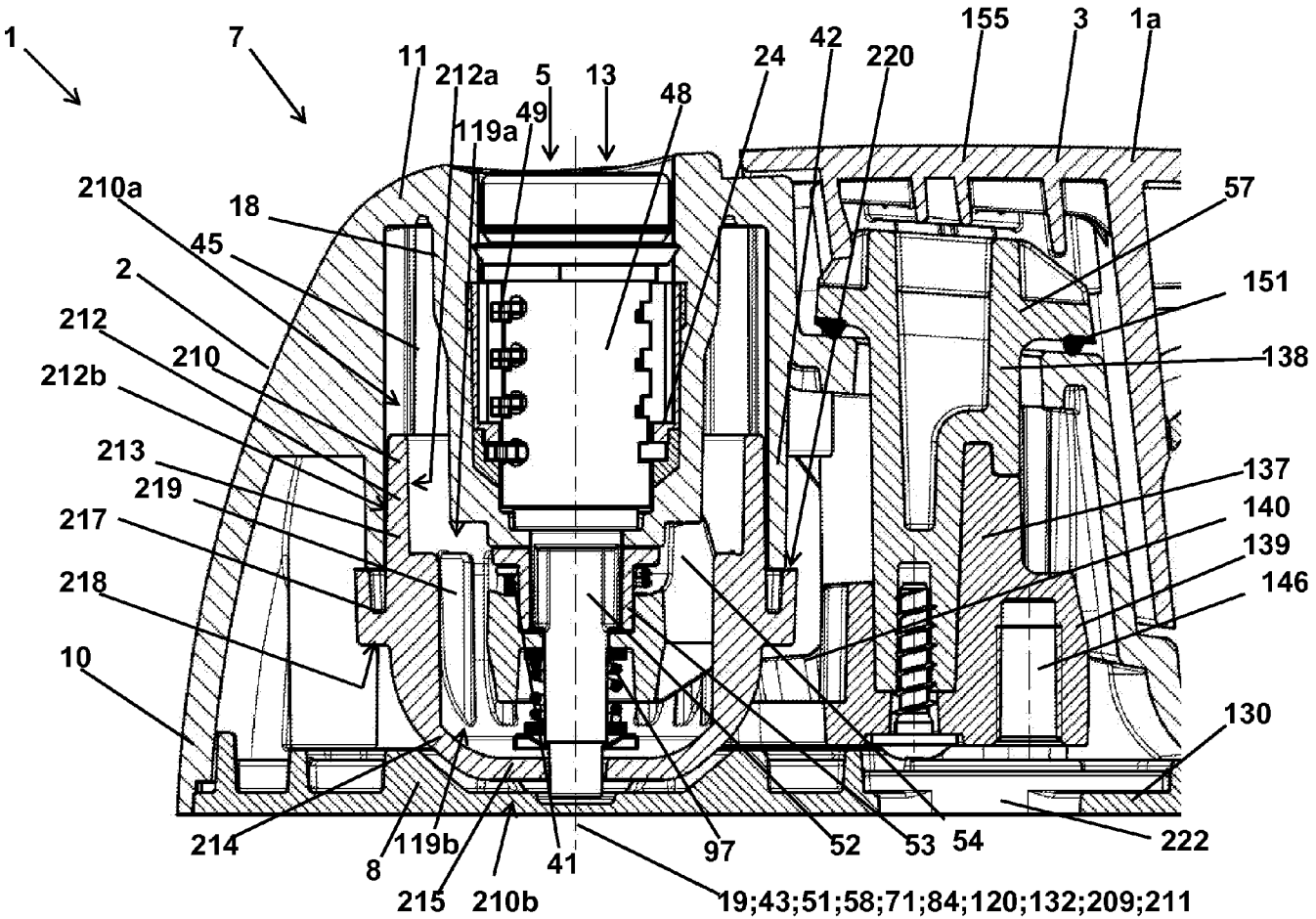
FIG. 35 is a longitudinal cross-sectional view through the pull handle in the non-activated position according to another embodiment of the invention.

According to another embodiment of the invention (FIGS. 35-37) the pull handle 1 features instead of the coupling sleeve 55 a locking sleeve 210. This serves to lock and unlock the pull handle 1.

The locking sleeve 210 (FIGS. 35-37) consists preferably of plastic and features a locking sleeve long axis 211 which is coaxial to the cylinder axis 51. In addition, the locking sleeve 210 features a first locking sleeve end 210*a* and a second locking sleeve end 210*b* opposite thereto. The cup-shaped locking sleeve 210 also features a locking sleeve wall 212 with a wall interior area 212*a* and a wall exterior area 212*b*. When viewed from the first locking sleeve end 210*b* in the direction of the locking sleeve long axis 211, the locking sleeve wall 212 then features a cylindrical bearing section 213. The bearing section 213 is constructed analogous to the bearing section 103 of the coupling sleeve. Connecting to the cylindrical bearing section 213 is a transition section 214 which corresponds to the transition section of the coupling sleeve 55. In the area of the transition section 214 the locking sleeve wall 212 tapers to the locking sleeve long axis 211. That means the outer diameter and the inner diameter of the locking sleeve wall 212 decrease. No guide section 105 connects to the transition area of the locking sleeve 210, but instead a locking sleeve base 215 which is preferably plate-shaped and extends perpendicular to the locking sleeve wall 211. The locking sleeve base 215 features a continuous base recess 216.

Except for the locking sleeve base 215, the locking sleeve 210 is constructed basically similar to the coupling sleeve 55. Instead of the coupling pins 106, the locking sleeve 210 indeed features two preferably radially opposite blocking strips 217 with respect to the locking sleeve long axis 211. The blocking strips 217 connect to the wall exterior area 212*b* of the locking sleeve wall 212 and protrude from it in a radial direction. In addition, the two blocking strips 217 extend in the circumferential direction of the locking sleeve wall 212. The blocking strips 217 exhibit a locking area 218 facing the second locking sleeve end 210*b* which preferably is level and perpendicular to the locking sleeve long axis 211. The blocking strips 217 also feature a blocking strip contact area 220 facing the first locking sleeve end 210*a* which is preferably level and perpendicular to the locking sleeve long axis 211. Furthermore the blocking strips 217 are positioned protruding from the first locking sleeve end 210*a* in the area of the bearing section 213. Two pass-through areas 221 are positioned between the two blocking strips 217.

However, the locking sleeve 210 does not feature guide slits to guide the locating sleeve 54 and a window to accommodate both spring pins 40, 82.

The locking sleeve 210 indeed features several ribs 219 positioned so as to be distributed in the circumferential direction of the locking sleeve 210, similar to the coupling sleeve 55. The ribs 219 connect to the wall interior area 212*a* of the locking sleeve wall 212 and protrude from it in a radial direction. The ribs 219 begin in the bearing section 213 and extend into the transition section 214. Furthermore the ribs 219 feature a first rib end 219*a* facing the first locking sleeve end 210*a* and a second rib end 219*b* facing the second locking sleeve end 210*b*. The first rib end 219*a* is separated from the first locking sleeve end 210*a*. The second rib end 219*b* is slightly separated from the locking sleeve base 215. An accommodation recess to accommodate the first torsion spring 114 is preferably not provided, since this is also not provided in the second embodiment of the pull handle 1.

In another embodiment of the pull handle 1 the cover 8 features no guide bushing 131 but instead only the cover plate 130. It is closed just where the guide bushing 131 would have been positioned. The cover plate 130 indeed features a continuous access recess 222 which is positioned in the area of the threaded hole 146 of the connection block 139. Consequently, the threaded bore 146 is accessible from outside and can be connected to the activation mechanism of a lock. In addition, the cover plate 130 features two further pass-through recesses which are penetrated by the fixing screws that are screwed into additional screw domes 223 with interior threading (FIGS. 36 and 37) of the bearing part 2.

Furthermore, the coupling pin 56 and the clamp ring 205 are absent in the other embodiments of the pull handle 1.

In the assembled state of the pull handle 1 according to another embodiment, the cover plate 130 of the cover 8 likewise connects to the bearing housing 7 at its open end.

The locating sleeve 54 is located in the bearing section 213 of the locking sleeve 210. The two latching arms 90 of the locating sleeve 54 are thereby located between two ribs 219 of the locking sleeve 210. The slide surfaces 91 of the latching arms 90 rest on the ribs 219. Consequently, the locating sleeve 54 is positioned in the area of the first rib end 219*a* of the ribs 219. The locking sleeve 210 thereby is connected to the locating sleeve 54 so as not to rotate around the cylinder axis 51 similar to the coupling sleeve 55. Or the locking sleeve 210 is connected to the locating sleeve 54 so as to be driven in rotation around the cylinder axis 51. Indeed, the locking sleeve 210 is not able to displace in an axial direction parallel to the cylinder axis 51 relative to the locating sleeve 54, in contrast to the coupling sleeve 55.

The locking sleeve 210 is namely mounted so as to be unable to displace but can rotate around the cylinder axis 51 in the bearing part 2, especially the bearing housing 7. Furthermore, the bearing section 213 of the locking sleeve 210 is positioned in the bearing sleeve 42 of the bearing housing 7. In particular, the wall exterior area 212*b* of the locking sleeve wall 212 rests on the bearing sleeve interior surface 44 in the area of the bearing section 213. In addition, the blocking strip contact areas 220 on the bearing sleeve end 42*b* rest on the bearing sleeve 42. Thus the locking sleeve 210 cannot be pushed further into the bearing sleeve 42, in contrast to the coupling sleeve 55. The locking sleeve base 215 is also positioned opposite the cover plate 130 and preferably rests on it. And the base recess 216 of the locking sleeve base 215 is penetrated by the foot end 52*b* of the adapter pin 52.

Figure 37:
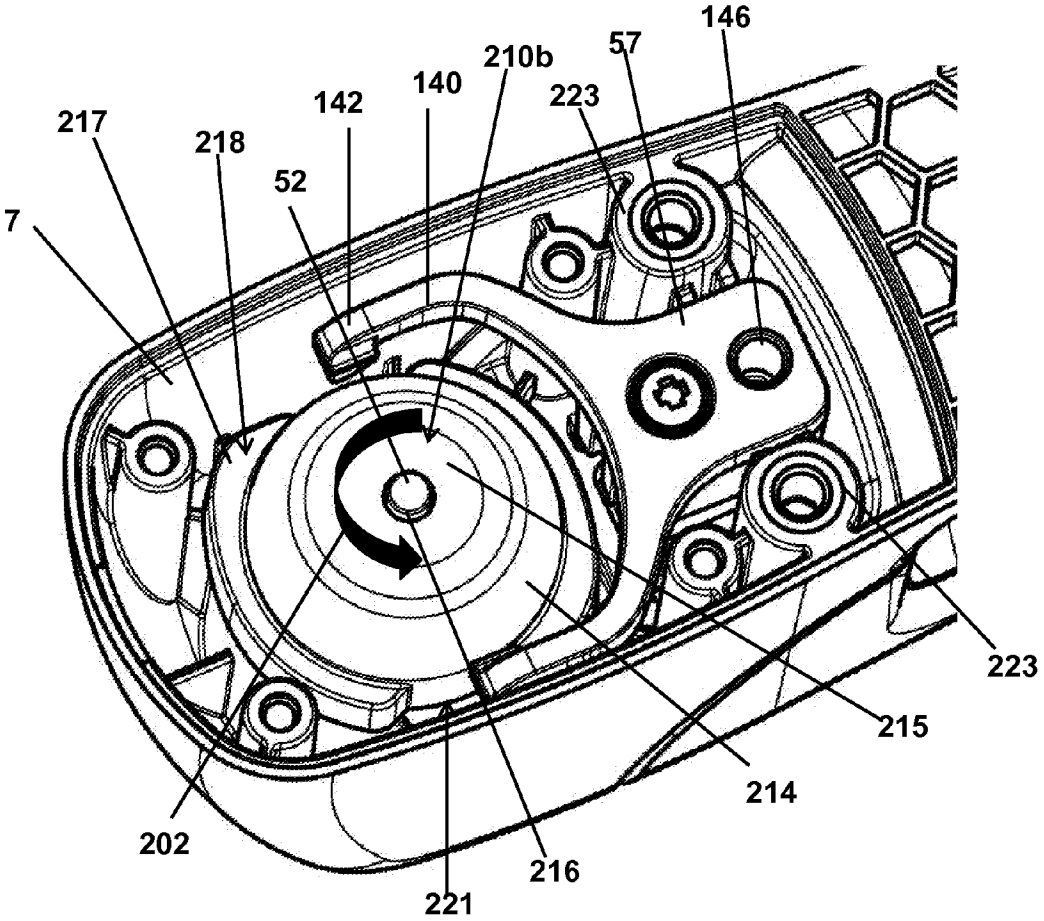
FIG. 37 is an overhead view of a part of the activation mechanism of the pull handle in unlocked position according to FIG. 35.

The two fork arms 140 of the driving fork 57 are positioned inside the bearing housing 7 and outside around the locking sleeve 210, in particular around the bearing area 213. The locking sleeve 210 is namely positioned in the receiving area 141. The activation protrusions 143 of the driving arms 140 do not thereby rest on the locking areas 218 of one of the blocking strips 217 of the locking sleeve 210. Moreover, the locking sleeve 210 is rotated with respect to the driving fork 57, so that the pass-through intermediate areas 221 are positioned in the area of the activation ends 142 of the fork arms 140 (FIG. 37). As a result, the fork arms 140 slide through the pass-through intermediate areas 221 outside on the locking sleeve 210. This is the unblocked condition of the pull handle 1 and the locking sleeve 210.

If the pull handle 1 is secured to an element of the vehicle door or lift-gate, the cover plate 130 is secured to the element in a known manner by means of the securing screws which are screwed into the screw domes 223. This type of securing is especially suited for applications which feature cramped installation conditions on the inside of the door.

Operation of the inventive pull handle 1 according to another embodiment is explained in greater detail below:

In order to activate the locking mechanism of the lock, an operator pulls on the handle part 3. As a result, the driving fork 57 and the threaded bore 146 are rotated in the handle activation direction 208. The locking sleeve 210 is not displaced. The activation ends 142 of the driving fork 140 are guided through the pass-through intermediate areas 221 and on the outside are guided past the locking sleeve 210. The element of the lock activation mechanism connected to the threaded bore 146 is thus likewise rotated in the handle activation direction 208. This then results in an activation of the respective lock mechanism.

Powered by the force of the torsion spring 179, upon release of the handle part 3 it rotates back into its non-activated position (FIG. 35) opposite the handle activation direction 208.

The above-described manner of functioning is applicable to a locked or unlocked pull handle 1, when the locking mechanism 5, especially the cylinder lock 13, is in its position not locking or unlocking the activation mechanism 4.

Figure 36:
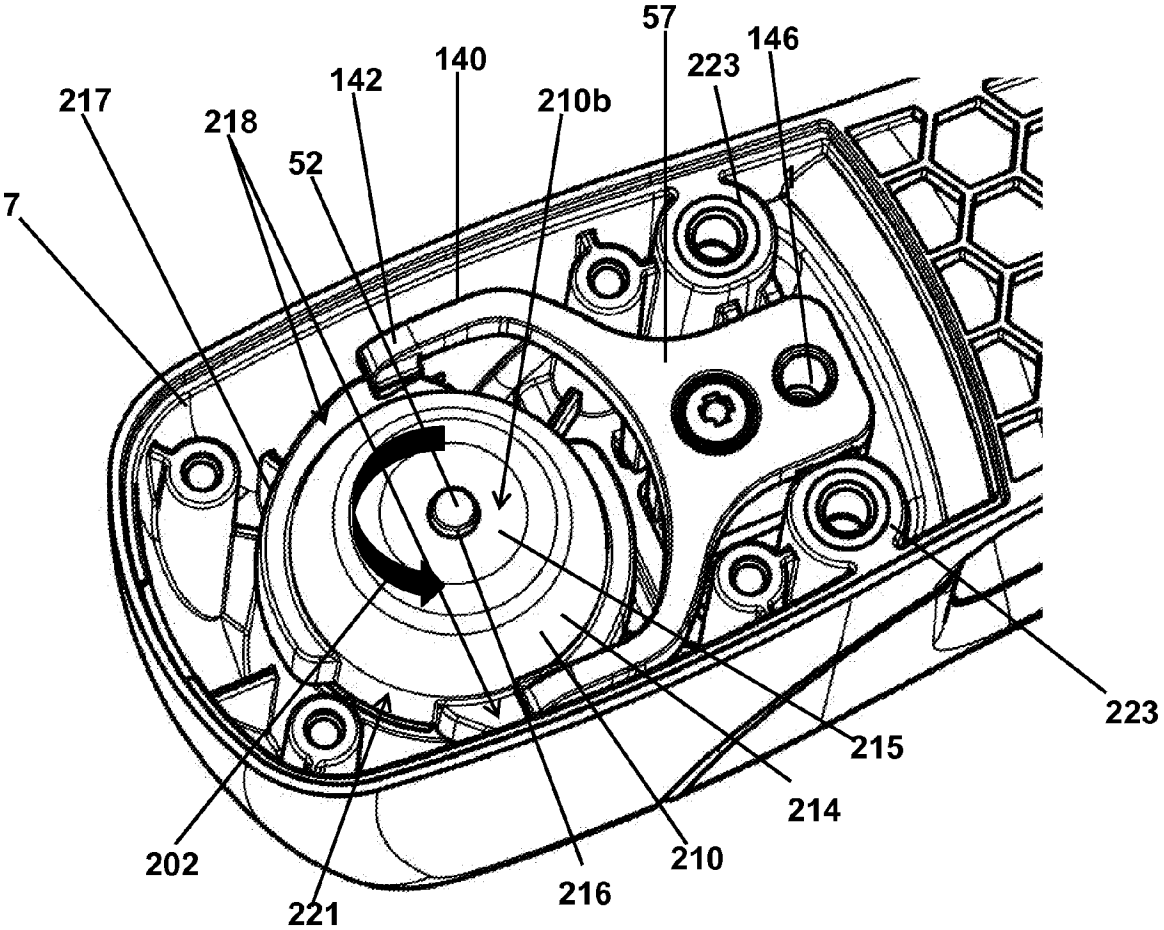
FIG. 36 is an overhead view of a part of the activation mechanism of the pull handle in the locked position according to FIG. 35.

If the pull handle 1 is locked, this occurs as described above. The locking sleeve 210 is driven in the locking direction 202 by the locating sleeve 54. Thus the blocking strips 217 are so twisted that they are positioned now in the direction of the cylinder axis 51 aligned to the activation protrusions 143 of the fork arms 140 (FIG. 36). As a result, the activation protrusions 143 rest on the locking areas 218 of the blocking strips 217.

The locking sleeve 210 is located in its locked position. The driving fork 57 can no longer be rotated in the handle activation direction 208. This movement is prevented by the locking sleeve 210. It blocks the driving fork 57 and via it the handle part 3. The locking mechanism can no longer be activated.

Otherwise the functioning of the pull handle 1 according to the second embodiment corresponds to the manner of functioning of the pull handle 1 according to the first embodiment. In particular the impulse circuit is likewise present with the free-wheel. The locating sleeve 54 and the locking sleeve 210 thus remain in their locked position after the release of the key. And with a new insertion of the key and turning in the locking direction 202, the locating sleeve 54 and the locking sleeve 210 are not moved again. And the locking likewise occurs similar to the first embodiment; the locking sleeve 210 is rotated by the locating sleeve 54 into its non-locked position in which it is decoupled from the driving fork 57.

The pull handle 1 according to the other embodiment is constructed in a very simple manner and features a high degree of functional reliability.

While the above description constitutes the preferred embodiment of the present invention, it will be appreciated that the invention is susceptible to modification, variation and change without departing from the proper scope and fair meaning of the accompanying claims.

The invention claimed is:

1. A pull handle (1) to unlock a lock of a door or lift-gate of a vehicle, including a construction machine or an agricultural vehicle, comprising:

a pull handle housing (1*a*) with a bearing part (2) for securing on the door or lift-gate and a handle part (3) connected to the bearing part (2) so as to swivel around a swivel axis (170), wherein the handle part (3) can be swiveled by pulling it from a non-actuated to an actuated position, an actuation mechanism (4) mounted in the pull handle housing (1*a*) to unlock the lock, wherein the actuation mechanism (4) can be actuated by pulling the handle part (3) and having a coupling element (56, 146) mounted in the pull handle housing (1*a*) to couple with coupling elements positioned outside the pull handle housing (1*a*) to unlock the lock, and a locking mechanism (5) positioned or mounted completely in the pull handle housing (1*a*) by means of which the actuation mechanism (4) can be disabled so that a pulling on the handle part (3) does not cause an activation of the coupling element (56) and thereby does not cause an unlocking of the lock, wherein the locking mechanism (5) includes means to decouple the handle part (3) from the coupling element (56) such that a pulling on the handle part (3) causes no actuation of the coupling element (56) and the handle part (3) performs a no-load stroke.

2. The pull handle (1) according to claim 1, wherein the coupling element (56) is a coupling pin (56).

3. The pull handle (1) according to claim 2, wherein the coupling pin (56) partially protrudes from the pull handle housing (1*a*) in the non-activated position of the handle part (3).

4. The pull handle according to claim 1, wherein the handle part (3) is connected to the bearing part (2) via an axle bolt (193) positioned completely inside the handle part (3) so as to swivel around the swivel axis (170).

5. A pull handle (1) to unlock a lock of a door or lift-gate of a vehicle, including a construction machine or an agricultural vehicle, comprising:

a pull handle housing (1*a*) with a bearing part (2) for securing on the door or lift-plate and a handle part (3) connected to the bearing part (2) so as to swivel around a swivel axis (170), wherein the handle part (3) can be swiveled by pulling it from a non-actuated to an actuated position, an actuation mechanism (4) mounted in the pull handle housing (1*a*) to unlock the lock, wherein the actuation mechanism (4) can be actuated by pulling the handle part (3) and having a coupling element (56, 146) mounted in the pull handle housing (1*a*) to couple with coupling elements positioned outside the pull handle housing (1*a*) to unlock the lock, and a locking mechanism (5) positioned or mounted completely in the pull handle housing (1*a*) by means of which the actuation mechanism (4) can be disabled so that a pulling on the handle part (3) does not cause an unlocking of the lock, wherein the locking mechanism (5) includes a cylinder lock (13) actuatable with a key, wherein the cylinder lock (13) comprises a 0-position, a lock position, and an unlock position, wherein the cylinder lock (13) can be brought out of the 0-position into the lock position by turning the key in a locking direction (202), and can brought out of the 0-position into the unlock position by turning the key opposite the lock direction (202), wherein the activation mechanism (4) is disabled by bringing the cylinder lock (13) into the lock position and is made functional again by bringing the cylinder lock (13) into the unlock position, and wherein the cylinder lock (13) automatically returns to the 0-position from the lock position and the unlock position without thereby changing the functional status of the activation mechanism (4).

6. The pull handle (1) according to claim 5, wherein the cylinder lock (13) comprises a lock cylinder (24) with a cylinder axis (51), a cylinder core (48) rotatable back and forth around the cylinder axis (51) after introduction of the key and spring-loaded disc tumblers (49) positioned therein.

7. The pull handle (1) according to claim 6, wherein the lock cylinder (24) is mounted in the bearing part (2) in a non-displaceable and non-rotatable manner.

8. The pull handle (1) according to claim 6, wherein the locking mechanism (5) comprises an adapter pin (52) which is connected to the cylinder core (48) so as not to rotate around the cylinder axis (51).

9. The pull handle (1) according to claim 8, wherein the locking mechanism (5) comprises a driving sleeve (53) which is connected to the adapter pin (52) so as not to rotate around the cylinder axis (51), wherein the driving sleeve (53) is positioned around an adapter pin shaft (61) of the adapter pin (52) and is positively connected thereon.

10. The pull handle (1) according to claim 9, wherein the driving sleeve (53) is connected to the cylinder core (48) so as to be drivable in a rotary manner around the cylinder axis (51) from a driving sleeve initial position to a driving sleeve lock position in the locking direction (202).

11. The pull handle (1) according to claim 10, wherein the driving sleeve (53) is connected to the cylinder core (48) so as to be drivable in a rotary manner around the cylinder axis (51) opposite the locking direction (202) from the driving sleeve initial position to a driving sleeve unlock position.

12. The pull handle (1) according to claim 11, wherein the driving sleeve (53) is connected to a spring (41) which after deflection into the driving sleeve lock or unlock position, drives the driving sleeve (53) back into the driving sleeve initial position.

13. The pull handle (1) according to claim 11, wherein the lock mechanism (5) comprises a latching sleeve (54) which is connected to the driving sleeve (53) so as to be drivable back and forth in a rotary manner around the cylinder axis (51), wherein the latching sleeve (54) and the driving sleeve (53) are able to rotate by a certain amount relative to each other around the cylinder axis (51).

14. The pull handle (1) according to claim 13, wherein by a rotation of the driving sleeve (53) from the driving sleeve initial position into the driving sleeve lock position, the latching sleeve (54) is driven by the driving sleeve (53) around the cylinder axis (51) in the locking direction (202), from a latching sleeve initial position into a latching sleeve lock position.

15. The pull handle (1) according to claim 14, wherein the driving sleeve (53) is connected to a spring (41) which after deflection into the driving sleeve lock or unlock position, drives the driving sleeve (53) back into the driving sleeve initial position and that the latching sleeve (54) is not driven by the driving sleeve (53) counter to the locking direction (202), when the driving sleeve (53) is turned back by the spring against the locking direction (202) from the driving sleeve lock position into the driving sleeve initial position.

16. The pull handle (1) according to claim 14, wherein by a rotation of the driving sleeve (53) from the driving sleeve initial position into the driving sleeve lock position, the latching sleeve (54) is driven by the driving sleeve (53) around the cylinder axis (51) counter to the locking direction (202), from a latching sleeve lock position into the latching sleeve initial position.

17. The pull handle (1) according to claim 16, wherein the driving sleeve (53) is connected to a spring (41) which after deflection into the driving sleeve lock or unlock position, drives the driving sleeve (53) back into the driving sleeve initial position and that the latching sleeve (54) is not driven by the driving sleeve (53) in the locking direction (202), when the driving sleeve (53) is turned back by the spring in the locking direction (202) from the driving sleeve unlock position to the driving sleeve initial position.

18. The pull handle (1) according to claim 13, wherein by a rotation of the driving sleeve (53) from the driving sleeve initial position into the driving sleeve lock position, the latching sleeve (54) is driven by the driving sleeve (53) around the cylinder axis (51) in the locking direction (202), from a latching sleeve initial position into a latching sleeve lock position and the latching sleeve (54) comprises latching means (90, 92) and the bearing part (2) comprises counter-latching means (33, 36, 37, 38) corresponding thereto, by means of which the latching sleeve (54) is held by snap-fit in its latching sleeve initial position and its latching sleeve lock position respectively.

19. The pull handle (1) according to claim 18, wherein the latching sleeve (54) comprises two latching arms (90) which each comprise on their free end a detent (92), and the bearing part (2) comprises a ring-shaped latching surface (33) corresponding thereto with two latching sections (36) lying radially opposite in relation to the cylinder axis (51), wherein each latching section (36) comprises two locking depressions (37) adjacent to each other in the circumferential direction in relation to the cylinder axis (51).

20. The pull handle (1) according to claim 19, wherein the locking mechanism (5) includes a spring (97), which forces the latching arms (90) into one of the latching depressions (37).

21. The pull handle (1) according to claim 13, wherein the activation mechanism (4) comprises a coupling sleeve (55) which is connected to the handle part (3) so as to be drivable linearly in an actuation direction (204) from a non-activated into an activated position.

22. The pull handle (1) according to claim 21, wherein the coupling sleeve (55) is connected to the latching sleeve (54) so as not to rotate around the cylinder axis (51).

23. A pull handle (1) according to claim 21, wherein the coupling sleeve (55) is mounted in the bearing part (2) so as to be displaceable linearly back and forth parallel to an actuation axis (209) and to rotate around the actuation axis (209).

24. The pull handle (1) according to claim 23, wherein the coupling element (56) is connected to the coupling sleeve (55) so as to be not displaceable parallel to the actuation axis (209).

25. The pull handle (1) according to claim 24, wherein the coupling element (56) is connected to the coupling sleeve (55) so as to be freely rotatable around the actuation axis (209).

26. The pull handle (1) according to claim 23, wherein the coupling element (56) is a coupling pin (56) and the coupling pin (56) comprises a coupling pin longitudinal axis (120) coaxial to the actuation axis (209) and is mounted in the coupling sleeve (55) so as to be not displaceable axially in relation to the coupling pin longitudinal axis (120) and so as to be freely rotatable around the coupling pin longitudinal axis (120).

27. The pull handle (1) according to claim 26, wherein the locking sleeve (210) includes a locking sleeve wall (212) with an inner wall area (212*a*) and an outer wall area (212*b*), wherein the locking sleeve (210) comprises two blocking strips (217) which adjoin the outer wall area (212*b*) of the locking sleeve wall (212) and radially protrude therefrom and respectively extend in a circumferential direction of the locking sleeve wall (212), wherein a pass-through area (221) is present between the two blocking strips (217).

28. The pull handle (1) according to claim 27, wherein the two blocking strips (217) are lying opposite to each other with respect to a locking sleeve longitudinal axis (211).

29. The pull handle (1) according to claim 27, wherein the blocking strips (217) exhibit a blocking strip contact area (220).

30. The pull handle (1) according to claim 29, wherein the actuation mechanism (4) includes a driving fork (57) which is connected to the handle part (3) so as to be not to rotatable around the swivel axis (170), wherein the driving fork (57) comprises two fork arms (140) which form a receiving area (141) between them and each have a free actuation end (142).

31. The pull handle (1) according to claim 30, wherein the fork arms (140) are positioned externally around the locking sleeve (210) and in a non-locking position of the locking sleeve (210) the free actuation ends (142) of the fork arms (140) are positioned aligned to the pass-through areas (221), so that the driving fork (57) can swivel by means of the handle part (3) around the swivel axis (170).

32. The pull handle (1) according to claim 31, wherein in a locking position of the locking sleeve (210), the free activation ends (142) of the fork arms (140) rest on one of the two blocking strip contact areas (220), so that the locking sleeve (210) is not able to swivel around the swivel axis (170) by means of the handle part (3) via the driving fork (57).

33. The pull handle (1) according to claim 21, wherein the coupling sleeve (55) comprises a coupling sleeve wall (100) with an inner wall area (100*a*) and an outer wall area (100*b*), wherein the coupling sleeve (55) comprises two coupling pins (106) which adjoin the outer wall area (100*b*) of the coupling sleeve wall (100) and radially protrude therefrom.

34. The pull handle (1) according to claim 33, wherein the two coupling pins (106) are radially opposite to each other relative to a longitudinal coupling sleeve axis (99).

35. The pull handle (1) according to claim 33, wherein the coupling pins (106) respectively comprise a coupling area (107).

36. The pull handle (1) according to claim 35, wherein the actuation mechanism (4) includes a driving fork (57) which is connected to the handle part (3) so as to be not to rotatable around the swivel axis (170), wherein the driving fork (57) comprises two fork arms (140) which form a receiving area (141) between them and each have a free actuation end (142).

37. The pull handle (1) according to claim 36, wherein the fork arms (140) are positioned externally around the coupling sleeve (55) and the free activation ends (142) of the fork arms (140) rest in a coupled position of the coupling sleeve (55) on one of two coupling areas (107), so that the coupling sleeve (55) is connected via the driving fork (57) to the handle part (3) so as to be drivable in the actuation direction (204).

38. The pull handle (1) according to claim 37, wherein the free activation ends (142) of the fork arms (140) are arranged in the coupled position of the coupling sleeve (55) aligned to the coupling areas (107) in the direction of the actuation axis (209).

39. The pull handle (1) according to claim 38, wherein in a decoupled position of the coupling sleeve (55), the free actuation ends (142) of the fork arms (140) are arranged not aligned to the coupling areas (107) in the direction of the actuation axis (209), so that the coupling sleeve (55) is not connected via the driving fork (57) to the handle part (3) so as to be drivable in the actuation direction (204).

40. The pull handle (1) according to claim 36, wherein the fork arms (140) are positioned inside the bearing part (2).

41. The pull handle (1) according to claim 40, wherein the driving fork (57) comprises a connection shaft (148) which is firmly connected on one end to the two fork arms (140) and is firmly connected on the other end to the handle part (3), wherein the connection shaft (148) penetrates through an opening (16) in the bearing part (2).

42. The pull handle (1) according to claim 13, wherein the actuation mechanism (4) comprises a locking sleeve (210) which is mounted in the bearing part (2) so as to be not displaceable but to be rotatable around an actuation axis (209).

43. The pull handle (1) according to claim 42, wherein the locking sleeve (210) is connected to the latching sleeve (54) so as to be not displaceable and to be not rotatable around the cylinder axis (51).

* * * * *